US011787008B2

(12) United States Patent
Wang et al.

(10) Patent No.: US 11,787,008 B2
(45) Date of Patent: Oct. 17, 2023

(54) CHEMICAL MECHANICAL POLISHING WITH APPLIED MAGNETIC FIELD

(71) Applicant: Applied Materials, Inc., Santa Clara, CA (US)

(72) Inventors: Xingfeng Wang, Santa Clara, CA (US); Jianshe Tang, San Jose, CA (US); Feng Q. Liu, San Jose, CA (US); David M. Gage, San Jose, CA (US); Stephen Jew, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 208 days.

(21) Appl. No.: 17/127,065

(22) Filed: Dec. 18, 2020

(65) Prior Publication Data

US 2022/0193859 A1 Jun. 23, 2022

(51) Int. Cl.
*B24B 37/04* (2012.01)
*B24B 57/02* (2006.01)
(Continued)

(52) U.S. Cl.
CPC ..... *B24B 37/046* (2013.01); *B24B 37/105* (2013.01); *B24B 37/20* (2013.01); *B24B 57/02* (2013.01)

(58) Field of Classification Search
CPC ..... B24B 37/046; B24B 37/105; B24B 37/20; B24B 57/02
(Continued)

(56) References Cited

U.S. PATENT DOCUMENTS 4,842,707 A * 6/1989 Kinoshita ..... H01J 37/3405 156/345.46
6,435,948 B1 * 8/2002 Molnar ..... B24B 1/005 451/28
(Continued)

FOREIGN PATENT DOCUMENTS

CN 1805823 A 7/2006
JP 05217979 8/1993
(Continued)

OTHER PUBLICATIONS

Machine Generated English Translation of JP 2003165050, Published Jun. 10, 2003, 14 pages. Submitted with the IDS of Apr. 5, 2022. (Year: 2003).*
(Continued)

*Primary Examiner* — Joel D Crandall
*Assistant Examiner* — Shantese L McDonald
(74) *Attorney, Agent, or Firm* — PATTERSON & SHERIDAN, LLP

(57) ABSTRACT

A polishing station for polishing a substrate using a polishing slurry is disclosed. The polishing station includes a substrate carrier having a substrate-receiving surface and a rotatable platen having a polishing pad disposed on a platen surface, where the polishing pad has a polishing surface facing the substrate-receiving surface. The polishing station includes an electromagnetic assembly disposed over the platen surface. The electromagnetic assembly includes an array of electromagnetic devices that are each operable to generate a magnetic field that is configured to pass through the polishing surface. The magnetic fields generated by the array of electromagnetic devices are oriented and configured to induce an electromagnetic force on a plurality of charged particles disposed in a polishing slurry disposed on the polishing surface. The applied magnetic field is configured
(Continued)

to induce movement of the plurality of charged particles in a direction parallel or orthogonal to the polishing surface.

18 Claims, 13 Drawing Sheets

(51) Int. Cl.
*B24B 37/20* (2012.01)
*B24B 37/10* (2012.01)

(58) Field of Classification Search
USPC ..... 451/36, 41, 59, 287
See application file for complete search history.

(56) References Cited

U.S. PATENT DOCUMENTS 7,670,466 B2 * 3/2010 Lee ..... B24B 37/26 204/224 M
9,550,269 B2 1/2017 Shiokawa et al.
10,651,012 B2 * 5/2020 Yokota ..... C23C 14/35
2006/0189256 A1 * 8/2006 Donis ..... H01L 21/3212 257/E21.244
2015/0298284 A1 * 10/2015 David ..... H01F 1/447 451/287
2018/0361525 A1 * 12/2018 Chou ..... H01L 22/20

FOREIGN PATENT DOCUMENTS

JP 2003-165050 A 6/2003
JP 2003165050 * 6/2003 ..... B24B 37/00
JP 2013-149722 A 8/2013

OTHER PUBLICATIONS

Grant et al., "Magnetic Field-Controlled Microfluidic Transport", JACS, Dec. 27, 2001; Contribution from the Department of Chemistry, University of Utah, Salt Lake City, Utah; vol. 124, No. 3, pp. 462-467.
International Search Report dated Mar. 7, 2022 for Application No. PCT/US2021/059751.

* cited by examiner

CHEMICAL MECHANICAL POLISHING WITH APPLIED MAGNETIC FIELD

BACKGROUND

Field

Embodiments described herein generally relate to equipment used in the manufacturing of electronic devices, and more particularly, to a chemical mechanical polishing (CMP) processing system having an applied magnetic field which may be used for profile tuning of and particle removal from the surface of a substrate disposed therein.

Description of the Related Art

Chemical mechanical polishing (CMP) is commonly used in the manufacturing of high-density integrated circuits to planarize or polish a layer of material deposited on a substrate. In a typical CMP process, a substrate is retained in a substrate carrier that presses the backside of the substrate towards a rotating polishing pad in the presence of a polishing fluid. Material is removed across the material layer surface of the substrate in contact with the polishing pad through a combination of chemical and mechanical activity which is provided by the polishing fluid, abrasive particles, and a relative motion of the substrate and the polishing pad. Typically, the abrasive particles are either suspended in the polishing fluid, known as a slurry, or are embedded in the polishing pad, known as a fixed abrasive polishing pad.

When abrasive particles are suspended in the polishing fluid (slurry) a non-abrasive polishing pad is typically used to transport the abrasive particles to the material layer of the substrate where the abrasive particles provide mechanical action, and in some embodiments, chemical reaction, with the surface thereof. Surface modification of the abrasive particles is used to enhance the polishing process. For example, coating abrasive particles with material layers having different chemical compositions alters surface characteristics including surface charge, zeta potential, reactivity, and hardness. Surface charge can be readily controlled not only based on surface chemistry but also based on slurry pH. For example, ceria abrasive particles used in dielectric CMP exhibit a positive charge in acidic slurry and a negative charge in alkaline slurry based on ceria isoelectric point of about pH 8. It will be appreciated that surface modification to control the surface charge of slurry particles is well known in the art.

Typical polishing processes offer inadequate control over the radial distribution of abrasive particles across the polishing surface. In some aspects, non-uniform distribution can result in areas of high and low abrasive particle concentration at different radial zones. Unfortunately, non-uniform abrasive particle distribution can result in poor surface profile control and within wafer (WIW) non-uniformity. Methods for controlling the distribution of abrasive particles are needed.

Typically, after one or more CMP processes are complete a polished substrate is further processed to one or more post-CMP substrate processing operations. For example, the polished substrate may be further processed using one or a combination of cleaning, inspection, and measurement operations. Typical post-polishing and cleaning processes are unable to completely remove abrasive particles. Unfortunately, retention of abrasive particles on the substrate surface can result in defect formation during subsequent process steps. Improved methods for removing abrasive particles are needed.

Once the post-CMP operations are complete, a substrate can be sent out of a CMP processing area to the next device manufacturing process, such as a lithography, etch, or deposition process.

Accordingly, what is needed in the art are apparatus and methods for solving the problems described above.

SUMMARY

Embodiments described herein generally relate to equipment used in the manufacturing of electronic devices, and more particularly, to a chemical mechanical polishing (CMP) processing system having an applied magnetic field which may be used for profile tuning of and particle removal from the surface of a substrate disposed therein.

In one embodiment, a polishing station includes a substrate carrier having a substrate-receiving surface. The polishing station includes a rotatable platen having a polishing pad disposed on a platen surface, the polishing pad having a polishing surface facing the substrate-receiving surface. The polishing station includes an electromagnetic assembly disposed over the platen surface. The electromagnetic assembly includes an array of electromagnetic devices that are each operable to generate a magnetic field that is configured to pass through the polishing surface. The magnetic fields generated by the array of electromagnetic devices are oriented and configured to induce an electromagnetic force on a plurality of charged particles disposed in a polishing slurry disposed on the polishing surface. The applied magnetic field is configured to induce movement of the plurality of charged particles in a direction parallel to the polishing surface.

In another embodiment, a method of polishing a substrate includes rotating a substrate disposed on a substrate-receiving surface. The method includes rotating a polishing pad disposed on a rotatable platen, the polishing pad having a polishing surface. The method includes urging a surface of the substrate against the polishing surface in the presence of a polishing slurry. The method includes generating a magnetic field that extends through the polishing surface. The magnetic field is generated by an electromagnetic assembly disposed over a surface of the rotatable platen, and the applied magnetic field is configured to apply a force to a plurality of charged particles disposed in the polishing slurry.

In yet another embodiment, a polishing station includes a substrate carrier having a substrate-receiving surface. The polishing station includes a rotatable platen having a polishing pad disposed on a platen surface, the polishing pad having a polishing surface facing the substrate-receiving surface. The polishing station includes an electromagnetic assembly disposed proximate an edge of the polishing pad. The electromagnetic assembly is operable to generate a magnetic field oriented substantially parallel to the polishing surface, and the applied magnetic field is configured to apply a force to a plurality of charged particles in the polishing slurry.

In yet another embodiment, a brush box cleaner for removing a plurality of charged particles from a surface of a substrate includes a platform having a plurality of rollers configured to rotatably support the substrate. The cleaner includes a rotatable scrubber having a plurality of brushes configured to contact the surface of the substrate. The cleaner includes a spray nozzle configured to apply a fluid to the surface of the substrate. The cleaner includes first and second electrodes disposed on opposite sides of the substrate, the electrodes operable to generate an electric field oriented substantially orthogonal to the surface of the substrate. The applied electric field is configured to detach charged particles from the surface of the substrate when the fluid is applied to the surface of the substrate. The cleaner includes a plurality of electromagnets disposed proximate an edge of the substrate, the plurality of electromagnets configured to generate a magnetic field oriented radially outward from a center of the substrate. The applied magnetic field is configured to induce an electromagnetic force on the plurality of charged particles. The applied electric and magnetic fields work in the same direction to exert an additive force on the plurality of charged particles.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments described herein generally relate to equipment used in the manufacturing of electronic devices, and more particularly, to a chemical mechanical polishing (CMP) processing system having an applied magnetic field which may be used for profile tuning of and particle removal from the surface of a substrate disposed therein.

Figure 1A:
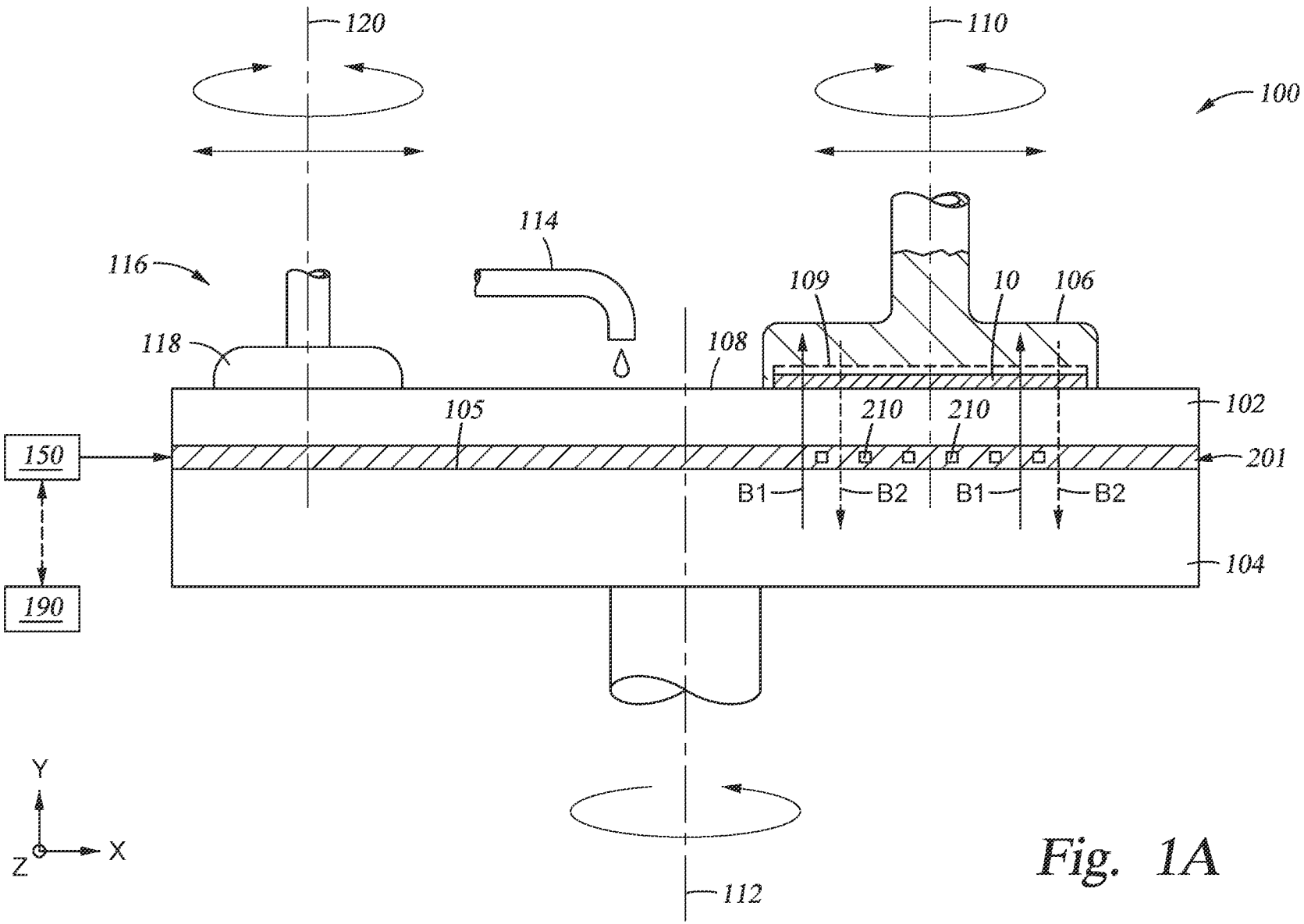
FIG. 1A is a schematic side view of an exemplary polishing station, according to one or more embodiments, which may be used as the polishing station for one or more of the polishing systems described herein.

FIG. 1A is a schematic side view of an example polishing station 100, which may be used as the polishing station for one or more of the polishing systems described herein. Here, the polishing station 100 features a platen 104 having a platen surface 105, a polishing pad 102 disposed on the platen surface 105 and secured thereto, and a substrate carrier 106. The substrate carrier 106 faces the platen 104 and the polishing pad 102 mounted thereon. The substrate carrier 106 is used to urge a material surface of a substrate 10 disposed therein, e.g., disposed on a substrate-receiving surface 109 thereof, against a polishing surface 108 of the polishing pad 102 while simultaneously rotating about a carrier axis 110. Typically, the platen 104 rotates about a platen axis 112 while the rotating substrate carrier 106 sweeps back and forth from an inner radius to an outer radius of the platen 104 to, in part, reduce uneven wear of the polishing pad 102 and improve the planarization of the surface of a substrate 10.

The polishing station 100 further includes a fluid delivery arm 114 and a pad conditioner assembly 116. The fluid delivery arm 114 is positioned over the polishing pad 102 and is used to deliver a polishing fluid, such as a polishing slurry having charged particles, such as abrasive particles and/or ions, suspended therein, to the surface 108 of the polishing pad 102. Using apparatus and/or methods disclosed herein, magnetic and/or electrostatic forces are used to control the distribution of the charged particles to tune polishing profiles and to enhance cleaning. As used herein, charged particles include all species carrying charge including both abrasive particles and ions. In some aspects, it may be generally appreciated that the distribution of abrasive particles affects the polishing profile. However, ion distribution may also affect the polishing profile, and therefore, it may be desirable to control ion distribution as well. For example, using aspects described herein, during polishing using high pH or low pH slurry, ion distribution may be used to control local pH which directly affects polishing rates. Moreover, using aspects described herein, the distribution and concentration of oxidizers within the slurry are controllable based on their ionic chemistry. Exemplary oxidizers may include ferric nitrate (e.g., $Fe(NO_3)_3$), potassium iodate (e.g., $KIO_3$), and potassium persulfate (e.g., $K_2S_2O_8$). In particular, during polishing using oxidizers comprising multivalent ions (e.g., $Fe^{3+}$ or $S_2O_8^{2-}$), the magnetic forces have increased effectiveness at controlling local oxidizer concentrations.

Typically, the polishing fluid contains a pH adjuster and other chemically active components, such as an oxidizing agent, to enable polishing of the material surface of the substrate 10. The pad conditioner assembly 116 is used to condition the polishing pad 102 by urging a fixed abrasive conditioning disk 118 against the surface 108 of the polishing pad 102 before, after, or during polishing of the substrate 10. Urging the conditioning disk 118 against the polishing pad 102 includes rotating the conditioning disk 118 about an axis 120 and sweeping the conditioning disk 118 from an inner diameter of the platen 104 to an outer diameter of the platen 104. The conditioning disk 118 is used to abrade, rejuvenate, and remove polish byproducts or other debris from the polishing surface 108 of the polishing pad 102.

Referring to FIG. 1A, an electromagnetic assembly 201 is disposed over the platen surface 105 so that the electromagnetic assembly 201 is disposed between the platen surface 105 and the polishing pad 102. In some other embodiments, the electromagnetic assembly 201 is embedded within one of the platen 104 or the polishing pad 102 (FIG. 1B) or embedded within the substrate carrier 106 (FIG. 1C). In some embodiments, the electromagnetic assembly 201 includes one or a plurality of electromagnetic devices 202 (FIG. 2C) configured to generate a stable and controllable magnetic field. Each of the electromagnetic devices 202 within the electromagnetic assembly 201 includes an electromagnet 210 that is electrically coupled to an electromagnet (EM) voltage source 150, e.g., a battery, for supplying electrical voltage to the one or the plurality of electromagnets 210. In one or more embodiments, the EM voltage source 150 is a DC voltage source. Each of the EM voltage sources 150 within the electromagnetic devices 202 are communicatively coupled to a controller 190. An orientation and magnetic field strength of the magnetic field generated by the electromagnetic assembly 201 is controlled, or regulated, by the EM voltage source 150 according to instructions executed by the controller 190.

In some embodiments, the electromagnetic devices 202 of the electromagnetic assembly 201 includes one or a plurality of permanent magnets (not shown) configured to generate a fixed or non-adjustable magnetic field within one or more regions of the platen surface 105. In this case, the magnetic field within one or more regions (e.g., separate radial regions or sectors) of the platen surface 105 can be adjusted by the selection of the field strength of magnets and/or number of magnets per unit area.

In one or more embodiments depicted in FIG. 1A, electrical current through portions of the electromagnetic devices 202 generates a magnetic field which is oriented at least in part orthogonal to the surface of the substrate 10 and/or polishing pad 102. Here, the provided electrical current flowing in a first direction generates a magnetic field B1 which is oriented substantially upwardly along the y-axis from the platen 104 toward the substrate carrier 106. Reversing the direction of the electrical current flow reverses the direction of the magnetic field, e.g., generating an opposite magnetic field B2 (shown in phantom) which is oriented substantially downwardly along the y-axis from the substrate carrier 106 toward the platen 104. Each of the magnetic fields B1, B2 is configured to pass through, or extend through, the polishing surface 108 and/or the substrate 10, thereby exerting a magnetic field generated force on the abrasive particles and/or ions disposed therebetween. In one or more embodiments, the applied magnetic field induces movement of the plurality of charged particles disposed on the polishing surface 108 in a direction parallel to the polishing surface 108. Increasing or decreasing the electrical current causes a proportional increase or decrease, respectively, in the magnetic field strength generated by one or more electromagnetic devices 202 within the electromagnetic assembly 201. In certain embodiments, it may be desirable to turn the magnetic field on and off such as by using pulsed DC voltage, which can switch between ON/OFF or positive/negative. The pulse time may be from about 1 second to about 120 seconds, and the stop time may be from about 0.1 seconds to about 10 seconds. In one or more embodiments, the magnetic flux density of the magnetic fields B1, B2 across the surface of a substrate 10 at any instant in time may be within a range of about 0 Tesla to about 3 Tesla.

Figure 1B:
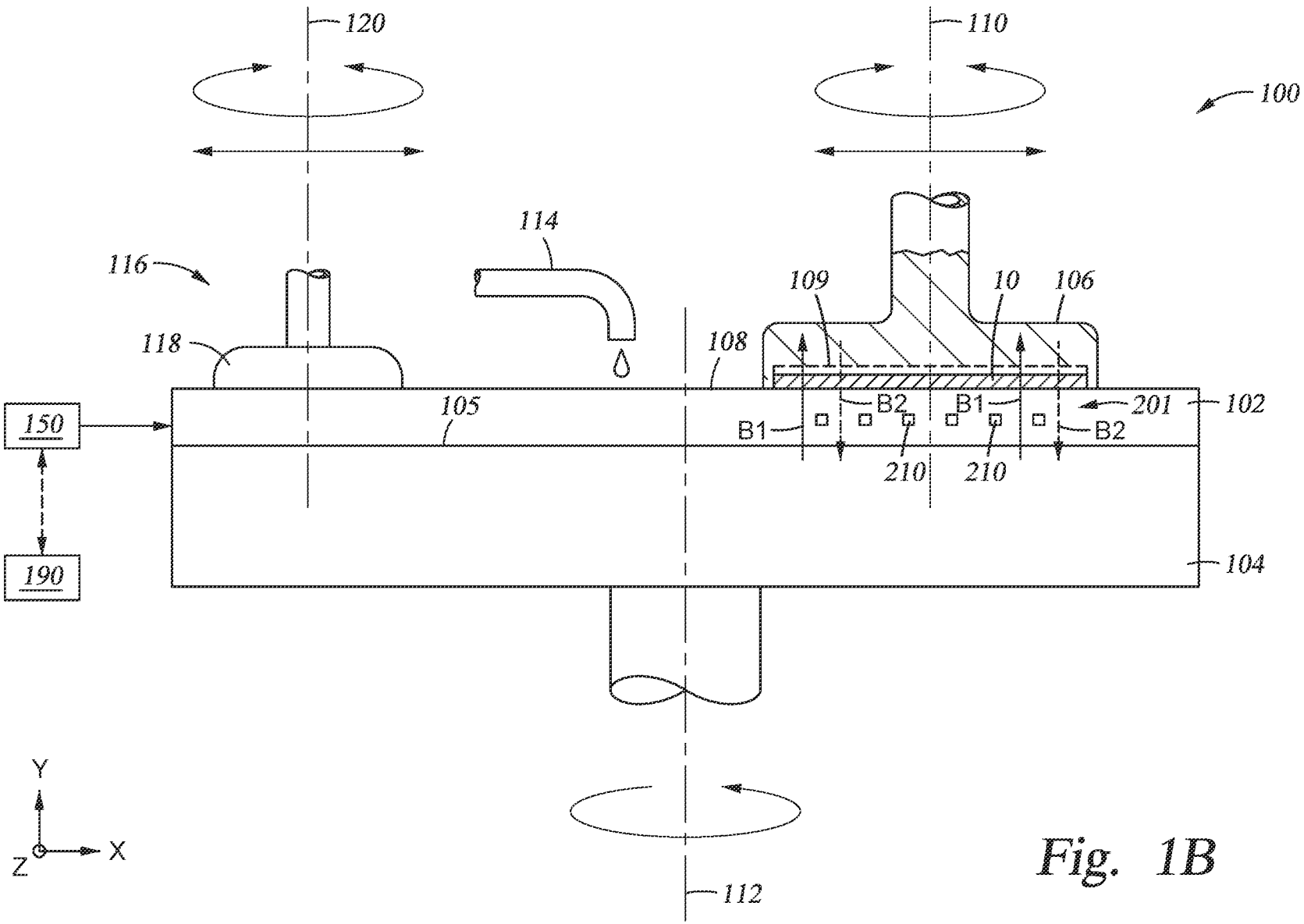
FIG. 1B is a schematic side view of another exemplary polishing station, according to one or more embodiments, which may be used as the polishing station for one or more of the polishing systems described herein.
Figure 1C:
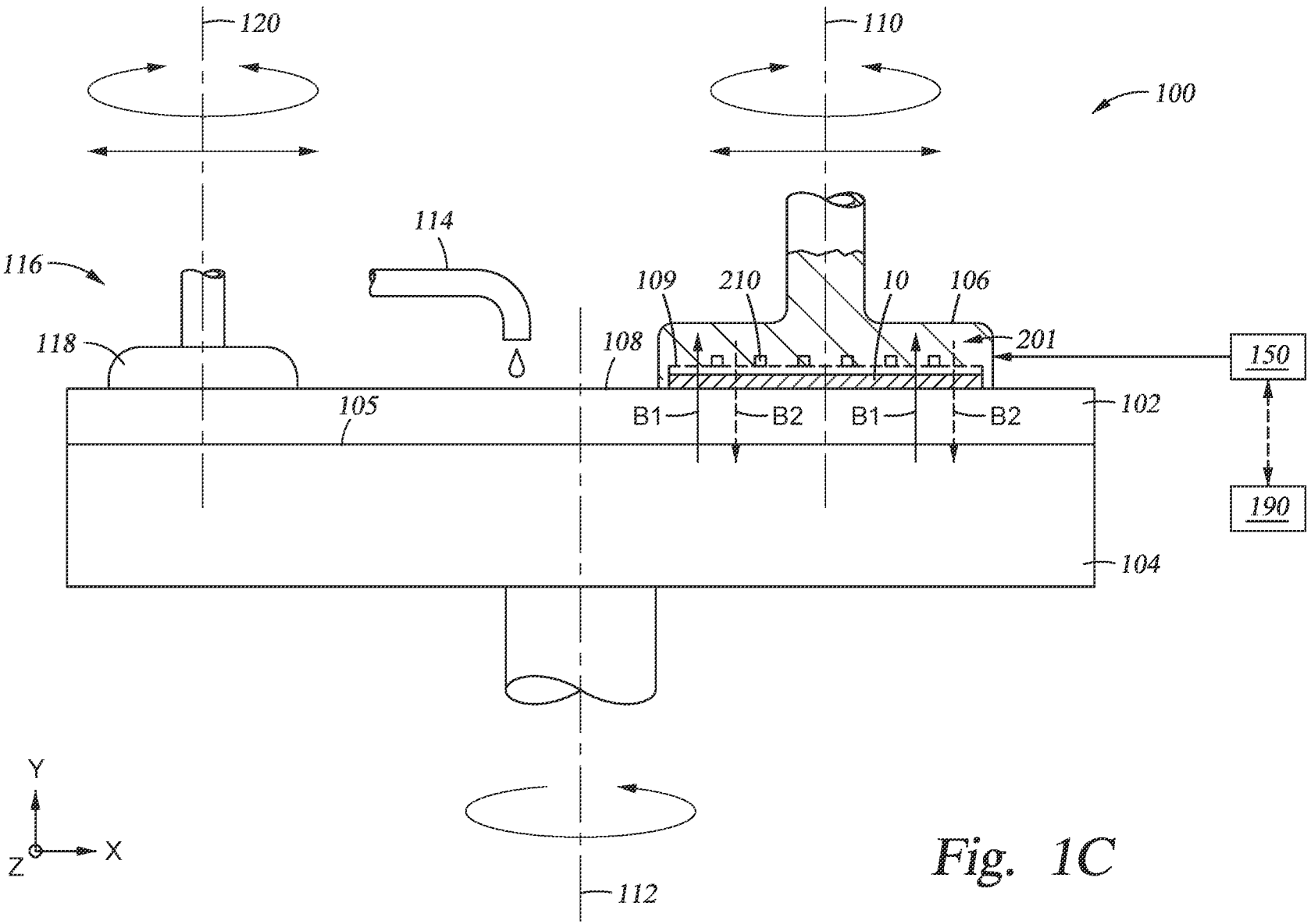
FIG. 1C is a schematic side view of another exemplary polishing station, according to one or more embodiments, which may be used as the polishing station for one or more of the polishing systems described herein.

FIG. 1B is a schematic side view of another example polishing station 100, which may be used as the polishing station for one or more of the polishing systems described herein. Referring to FIG. 1B, a plurality of electromagnets 210 within each electromagnetic device 202 within the electromagnetic assembly 201 are embedded directly within the polishing pad 102. Beneficially, having the electromagnets 210 embedded within the polishing pad 102 instead of being positioned on or within the platen 104 locates the magnetic field source, e.g., the plurality of electromagnets 210, closer to the polishing surface 108 and, thus, closer to the interface between the substrate 10 and the polishing surface 108. In certain embodiments, the closer proximity of the magnetic field source improves directionality of the magnetic field such that the magnetic field lines passing through the polishing surface 108 are oriented substantially parallel to each other. Likewise, the closer proximity of the magnetic field source can increase magnetic field density and uniformity across the polishing surface 108. On the other hand, having the electromagnetic assembly 201 embedded within the platen 104 (FIG. 1A) can be advantageous, according to certain embodiments, for circumventing design modifications to the polishing pad 102, and allows the polishing pad to be removed separately from the electromagnetic assembly 201 components.

FIG. 1C is a schematic side view of another example polishing station 100, which may be used as the polishing station for one or more of the polishing systems described herein. Referring to FIG. 1C, a plurality of electromagnets 210 within each electromagnetic device 202 within the electromagnetic assembly 201 are embedded within the substrate carrier 106, e.g., located behind the substrate-receiving surface 109 thereof. It is contemplated that the plurality of electromagnets 210 may be in close proximity to a back side of the substrate 10.

Figure 1D:
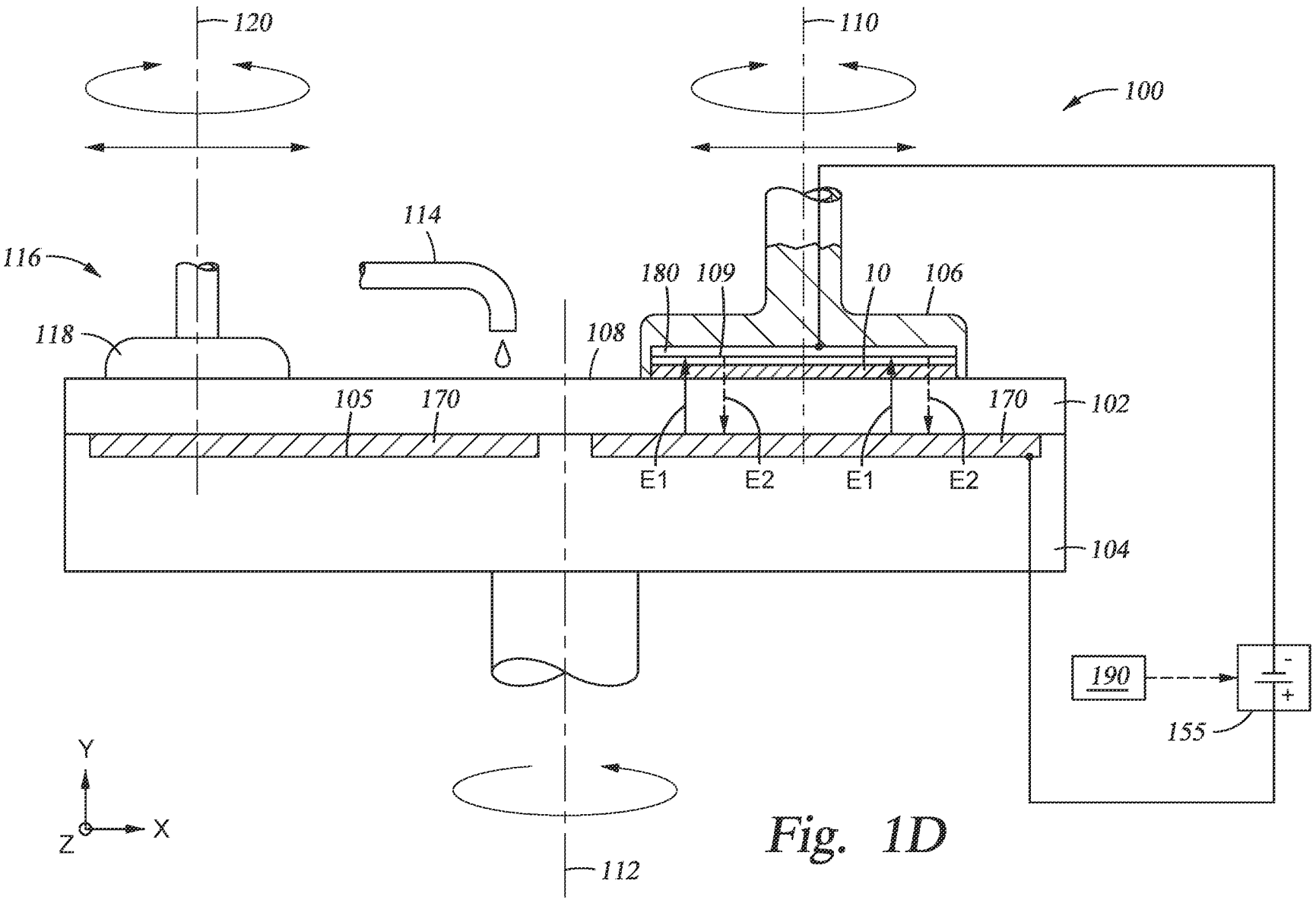
FIG. 1D is a schematic side view of another exemplary polishing station, according to one or more embodiments, which may be used as the polishing station for one or more of the polishing systems described herein.
Figure 1E:
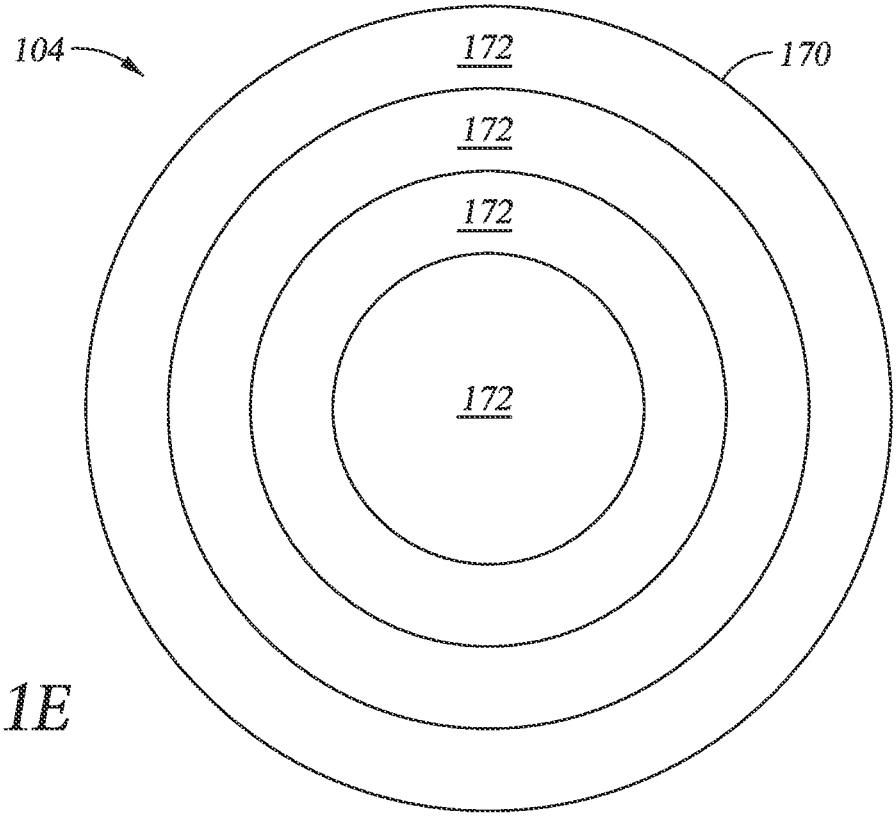
FIGS. 1E and 1F are schematic top views of exemplary platens, according to one or more embodiments, which may be used in one or more of the polishing stations described herein.
Figure 1F:
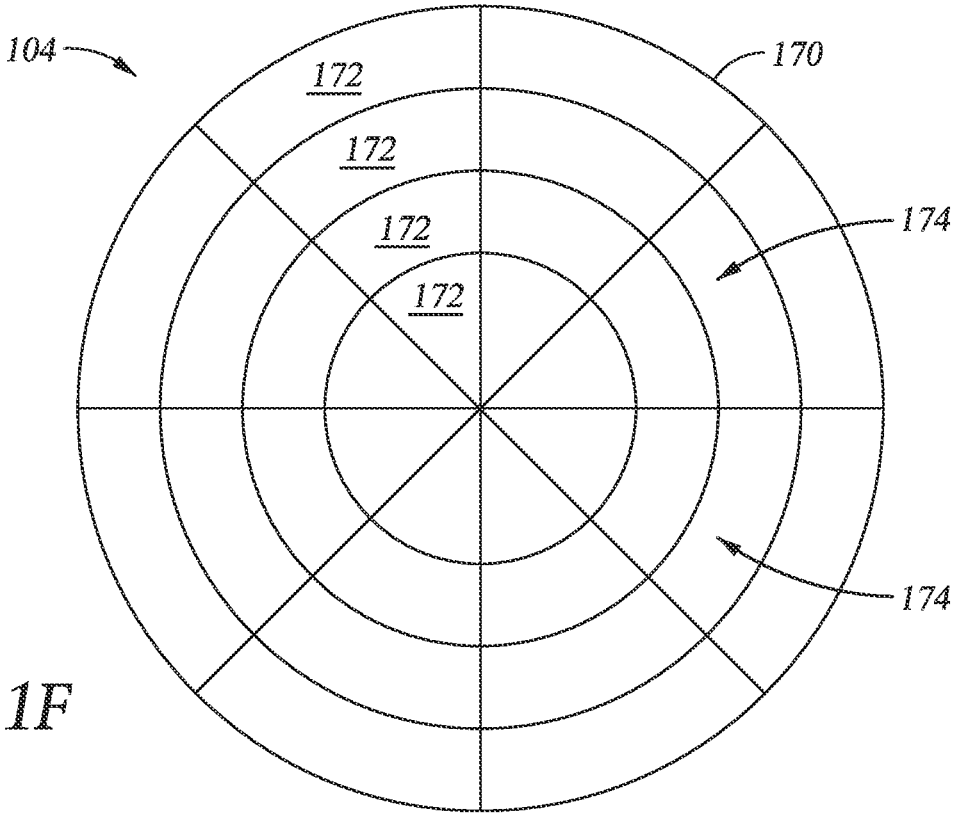

FIG. 1D is a schematic side view of another example polishing station 100, which may be used as the polishing station for one or more of the polishing systems described herein. Referring to FIG. 1D, the polishing station 100 includes a platen electrode 170 embedded within the platen 104, e.g. proximate an interface between the platen 104 and the polishing pad 102 mounted thereon. In some other embodiments (not shown), the platen electrode 170 is embedded within the polishing pad 102. The platen electrode 170 is electrically coupled to an electrode voltage source 155, e.g., a battery or power supply. For example, an electrical lead connected to a positive terminal of the voltage source 155 is coupled to the rotatable platen 104 by a slip ring (not shown). The polishing system 100 includes a carrier electrode 180 embedded within the substrate carrier 106, e.g., located behind the substrate-receiving surface 109 thereof. Opposing faces of the platen electrode 170 and the carrier electrode 180 are spaced apart from each other at least in part orthogonal to the surface of the substrate 10. The carrier electrode 180 is electrically coupled to the electrode voltage source 155, e.g. coupled to an opposite terminal thereof relative to the platen electrode 170. For example, an electrical lead connected to a negative terminal of the voltage source 155 is coupled to the rotatable substrate carrier 106 by a slip ring (not shown) coupled to a carrier rotation assembly (not shown). Similar to the EM voltage source 150, the electrode voltage source 155 is configured to supply electrical voltage to the platen and carrier electrodes 170, 180. In this example, an electrical lead connected to a negative terminal of the voltage source 155 is coupled to the rotatable substrate carrier 106 by a slip ring (not shown) coupled to a carrier rotation assembly (not shown) and an opposing electrical lead connected to a positive terminal of the voltage source 155 is coupled to the rotating platen 104 by a slip ring (not shown) coupled to a platen rotation assembly (not shown). In one or more embodiments, the electrode voltage source 155 is a DC voltage source. The application of electrical voltage across the platen and carrier electrodes 170, 180 generates an electric field therebetween. In some other embodiments (not shown), the electric field is generated using a single electrode. For example, in some embodiments, the platen electrode 170 is electrically coupled to a voltage source, e.g., an AC voltage source (not shown), and the carrier electrode 180 is grounded, or vice versa. In some embodiments, the platen electrode 170 can include a plurality of sub-platen electrodes 172 that are distributed across the surface of the platen 104 and are configured to be biased at different voltages by use of separate voltage sources 155 during processing. In some embodiments, the sub-platen electrodes 172 are distributed in a radial pattern (e.g., two or more concentric rings) (FIG. 1E) or as sectors 174 across the platen surface (FIG. 1F).

The electrode voltage source 155 is communicatively coupled to the controller 190. An orientation and electric field strength of the electric field generated by the opposing platen and carrier electrodes 170, 180 is controlled, or regulated, by the electrode voltage source 155 according to instructions executed by the controller 190. In one or more embodiments depicted in FIG. 1D, supplying an electrical voltage to the platen and carrier electrodes 170, 180 generates an electric field which is oriented at least in part orthogonal to the surface of the substrate 10. Here, supplying voltage having a first polarity generates an electric field E1 which is oriented substantially upwardly along the y-axis from the platen 104 toward the substrate carrier 106. Reversing the polarity reverses the direction of the electric field, e.g., generating an opposite electric field E2 (shown in phantom) which is oriented substantially downwardly along the y-axis from the substrate carrier 106 toward the platen 104. Each of the electric fields E1, E2 is configured to pass through the interface between the substrate 10 and the polishing surface 108, thereby exerting an electrostatic force to abrasive particles and/or ions disposed therebetween. Increasing or decreasing the electrical voltage causes a proportional increase or decrease, respectively, in the electric field strength generated by the opposing platen and carrier electrodes 170, 180. In one or more embodiments, the electric field strength of the electric fields E1, E2 is from about 0 MV/m to about 8 MV/m.

In one or more embodiments, the electric field applies an electrostatic force, known as a Coulomb force, to a plurality of charged particles in the polishing slurry. The Coulomb force is an attractive physical force between opposite charges. For example, when the electric field E1 is applied, a particle having a negative charge will be attracted towards the positive platen electrode 170, whereas a particle having a positive charge will be attracted towards the negative carrier electrode 180. It will be appreciated that reversing the polarity of the electrodes 170, 180, e.g., by applying electric field E2, will reverse the direction of the Coulomb forces. Because Coulomb forces for point charges are proportional to the product of the charges, increasing the voltage differential between the electrodes 170, 180 results, in general, in a proportional increase in the magnitude of the Coulomb force on a particle at a given distance from the electrodes 170, 180. In one or more embodiments, the particle distribution and local concentration with respect to the interface between the surface of the substrate 10 and the polishing surface 108 can be controlled by adjusting the polarity and voltage differential of the electrodes 170, 180 using the electrode voltage source 155 according to instructions received from the controller 190. In some embodiments, application of one or more of the electric fields E1, E2 during post-polish rinsing or dechucking may remove charged particles from the substrate 10 by applying an electrostatic force away from the substrate carrier 106 and in the direction of the polishing pad 102. In one or more embodiments, the polishing slurry also includes ionic species in addition to the charged particles, which are similarly affected by the applied magnetic and electric fields described herein.

It is contemplated that one or more of the embodiments illustrated in FIGS. 1A-1D may be combined without limitation. In other words, the magnetic and electric field forces may work either individually or collectively. In one or more other embodiments, it is contemplated that the polishing station 100 may include one or a plurality of electromagnets 310 disposed proximate an edge of the polishing pad 102. The one or the plurality of electromagnets 310 may be used during post-polish rinse or dechucking as described in more detail with respect to FIGS. 3A-3B.

Figure 1G:
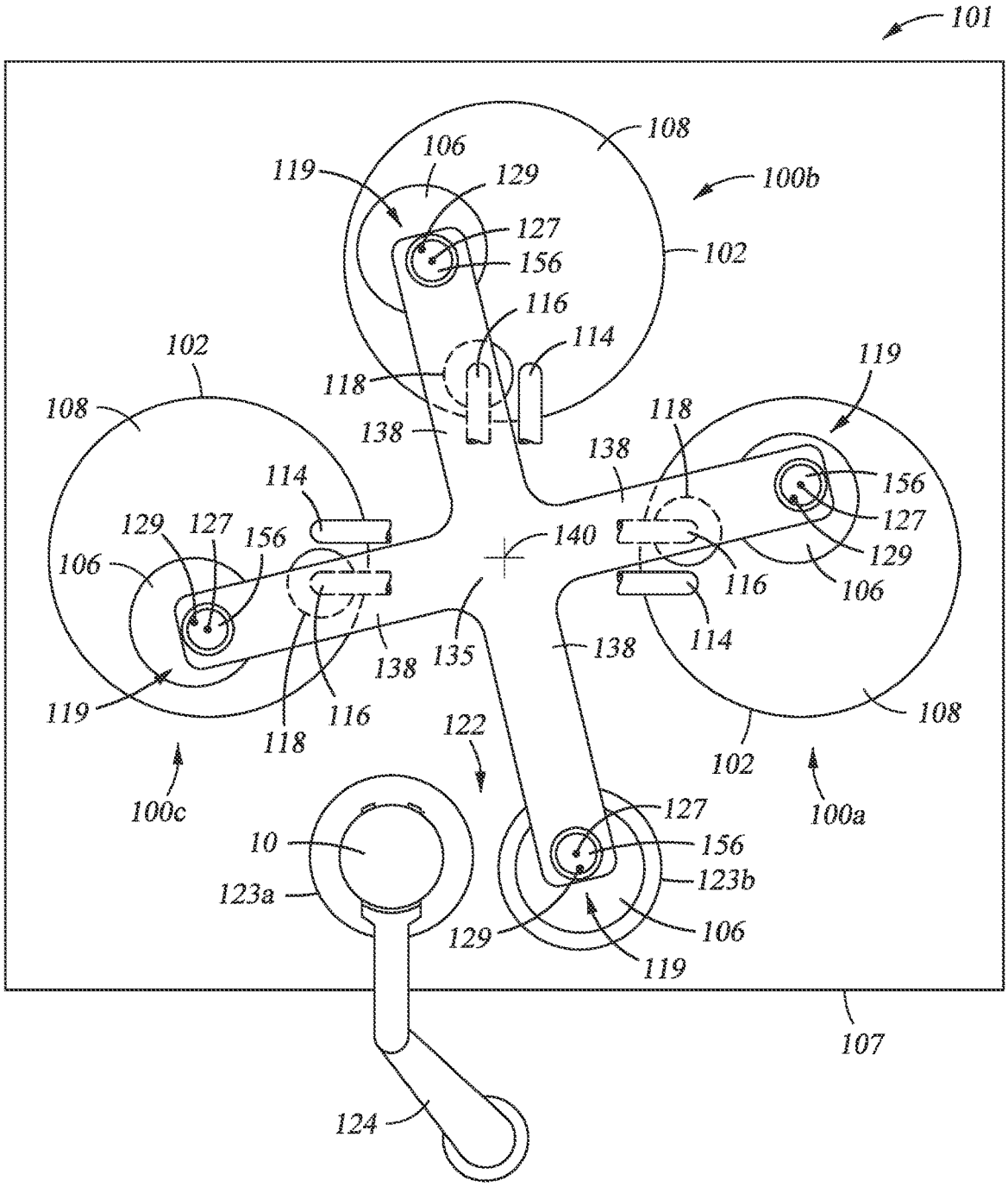
FIG. 1G is a top view of a CMP system with multiple polishing stations and a cross carousel for the movement of substrate carriers, according to one or more embodiments.
Figure 1G:
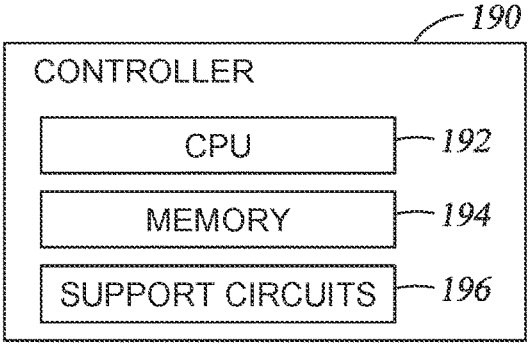
Figure 1H:
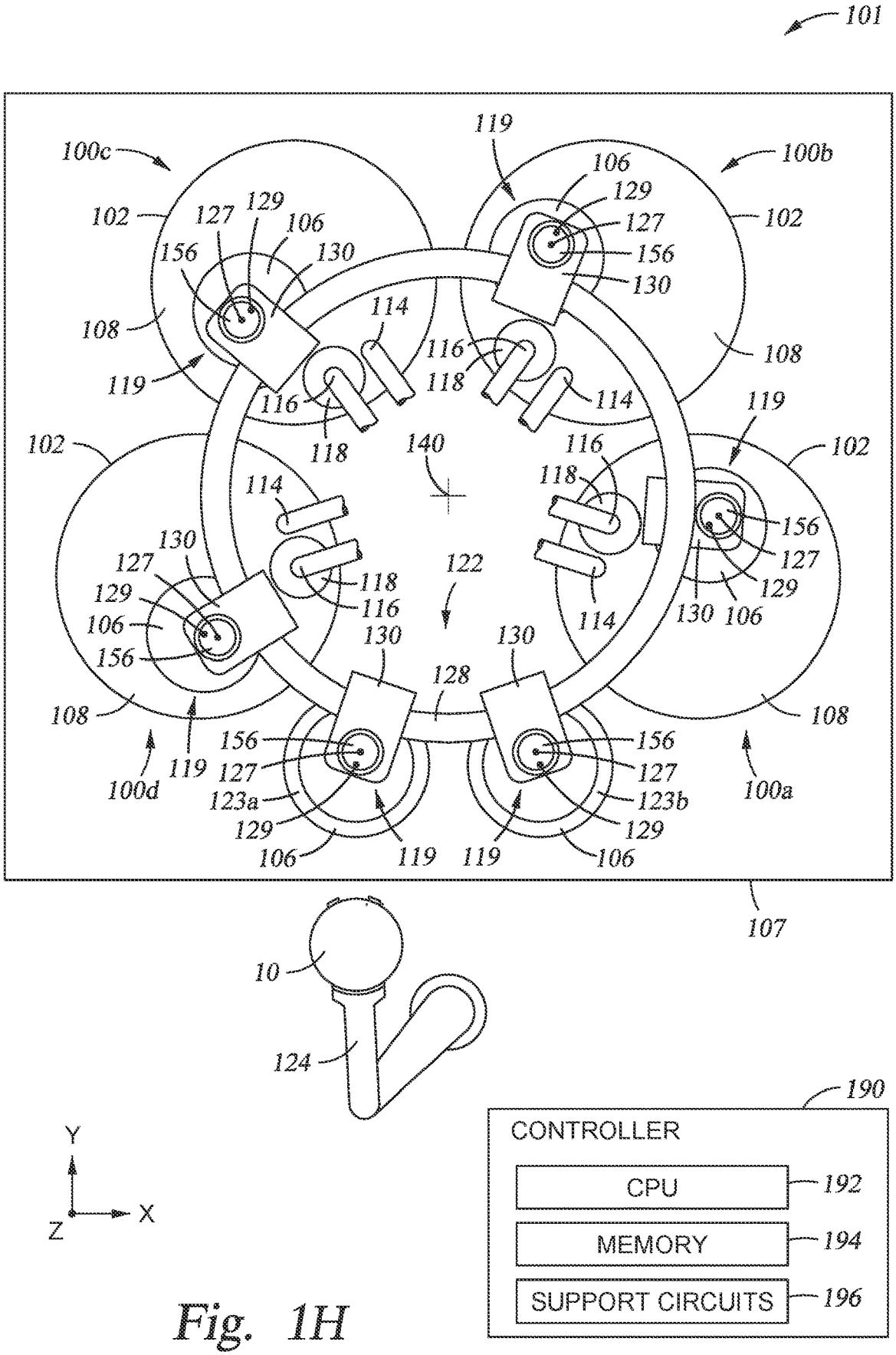
FIG. 1H is a top view of a CMP system with multiple polishing stations and a curved track for the movement of a substrate carrier, according to one or more embodiments.

FIG. 1G illustrates a plan view of a polishing system 101 for processing one or more substrates, according to one embodiment. The polishing system 101 includes a polishing platform 107 that at least partially supports and houses a plurality of polishing stations 100*a*-100*c* and load cups 123*a*-123*b*. In some embodiments, the number of polishing stations can be equal to or greater than one. For example, the polishing apparatus can include four polishing stations 100*a*, 100*b*, 100*c* and 100*d* (FIG. 1H).

Each polishing station 100 is adapted to polish a substrate 10 that is retained in a substrate carrier 106 within a carrier head assembly 119 that moves along a circular path. In one or more embodiments illustrated in FIG. 1G, each carrier head assembly 119 is supported on a carousel 135 with a plurality of carousel arms 138. In other words, each carrier head assembly 119 is suspended from one of the plurality of carousel arms 138 below the carousel 135. The substrate carrier 106 is coupled to the carousel arm 138 via a supporting structure (not shown), which may include brackets and other mounting components. Rotation of the carousel 135 about a central axis 140 moves all of the substrate carriers 106 simultaneously along the circular path. The carousel 135 allows uniform transfer of all the substrate carriers 106 and associated substrates 10 simultaneously. In one or more embodiments, the carousel 135 can rotationally oscillate during polishing, thereby causing each of the substrate carriers 106 to oscillate laterally (x-y plane). The substrate carrier 106 is generally translated laterally across the top surface of the polishing pad 102 during polishing. The lateral sweep is in a direction parallel to the polishing surface 108 of the polishing pad 102 (FIG. 1A). The lateral sweep can be a linear or arcuate motion. Each of the above embodiments that allow for additional modes of oscillation or motion allows for even more relative motion between the polishing surface 108 and the substrate 10, increasing the polishing rate on the substrate 10.

The polishing system 101 includes a multiplicity of substrate carriers 106, each of which is configured to carry a substrate 10. The number of substrate carriers can be an even number equal to or greater than the number of polishing stations, e.g., four substrate carriers or six substrate carriers. For example, the number of substrate carriers can be two greater than the number of polishing stations. This permits loading and unloading of substrates to be performed from two of the substrate carriers while polishing occurs with the other substrate carriers at the remainder of the polishing stations, thereby providing improved throughput.

The polishing system 101 also includes a loading station 122 for loading and unloading substrates from the substrate carriers 106. The loading station 122 can include a plurality of load cups 123, e.g., two load cups 123*a*, 123*b*, adapted to facilitate transfer of a substrate between the substrate carriers 106 and a factory interface (not shown) or other device (not shown) by a transfer robot 124. The load cups 123 generally facilitate transfer between the robot 124 and each of the substrate carriers 106.

The stations of the polishing system 101, which include the loading station 122 and the polishing stations 100, can be positioned at substantially equal angular intervals around the center of the polishing platform 107. This is not required, but can provide the polishing system 101 with a good lateral footprint. Each polishing station 100 of the polishing system 101 can include a port, e.g., at the end of a carousel arm 138, to dispense polishing liquid, such as abrasive and/or ionic slurry, onto the polishing surface 108. Each polishing station 100 of the polishing system 101 can also include a pad conditioner assembly 116 to abrade the polishing surface 108 to maintain the polishing surface 108 in a consistent abrasive state. The platen 104 at each polishing station 100 is operable to rotate about the platen axis 112. For example, a motor (not shown) can turn a drive shaft (not shown) to rotate the platen 104. Each substrate carrier 106 is operable to hold a substrate 10 against the polishing surface 108. In operation, the platen 104 is rotated about the platen axis 112, which provides polishing to the substrate 10. Each substrate carrier 106 can have independent control of some of the polishing parameters, for example pressure, associated with each respective substrate. In particular, each substrate carrier 106 can include a retaining ring (not shown) to retain the substrate 10 below a flexible membrane (not shown).

The carrier head assembly 119 includes a carrier head rotation motor 156. In some embodiments, an axis 127 extending through a drive shaft (not shown) of the carrier head rotation motor 156 is separated from a carrier head axis 129 by an offset distance (alternately referred to as an offset).

In some other implementations each carrier head assembly 119 translates along an overhead track 128 (FIG. 1H). The carrier head assembly 119 is moved along the track 128 by a carrier motor (not shown) attached to a carriage 130. The carriage 130 generally includes structural elements that are able to guide and facilitate the control of the position of the carrier head assembly 119 along the overhead track 128. Each carrier head assembly 119 is suspended from one of the plurality of carriages 130 below the track 128. In some embodiments, the carrier motor and the carriage 130 include a linear motor and linear guide assembly that are configured to position the carrier head assembly 119 along all points of the circular overhead track 128.

In one or more embodiments depicted in FIG. 1H, each substrate carrier 106 can oscillate laterally (x-y plane) during polishing, e.g., by driving the carriage 130 on the track 128. The substrate carrier 106 is generally translated laterally across the top surface of the polishing surface 108 during polishing. The lateral sweep is in a direction parallel to the polishing surface 108 (FIG. 1A). The lateral sweep can be a linear or arcuate motion. Each of the above embodiments that allow for additional modes of oscillation or motion allows for even more relative motion between the polishing surface 108 and the substrate 10, increasing the polishing rate on the substrate.

In one or more embodiments depicted in FIG. 1H, the overhead track 128 has a circular configuration which allows the carriages 130 retaining the substrate carriers 106 to be selectively orbited over and/or clear of the loading stations 122 and the polishing stations 100. The overhead track 128 may have other configurations including elliptical, oval, linear or other suitable orientation.

A controller 190, such as a programmable computer, is connected to each motor to independently control the rotation rate of the platen 104 and the substrate carriers 106. For example, each motor can include an encoder that measures the angular position or rotation rate of the associated drive shaft. In one or more embodiments, the controller 190 is connected to a carousel motor driving rotation of the carousel 135. In some other embodiments, the controller 190 is connected to the carrier motor in each carriage 130 to independently control the lateral motion and position of each substrate carrier 106 along the track 128. For example, each carrier motor can include a linear encoder that monitors and controls the position of the carriage 130 along the track 128.

The controller 190 can include a central processing unit (CPU) 192, a memory 194, and support circuits 196, e.g., input/output circuitry, power supplies, clock circuits, cache, and the like. The memory 194 is connected to the CPU 192. The memory is a non-transitory computable readable medium, and can be one or more readily available memory such as random access memory (RAM), read only memory (ROM), floppy disk, hard disk, or other form of digital storage. In addition, although illustrated as a single computer, the controller 190 could be a distributed system, e.g., including multiple independently operating processors and memories. This architecture is adaptable to various polishing situations based on programming of the controller 190 to control the order and timing that the substrate carriers are positioned at the polishing stations.

For example, some polishing recipes are complex and require three or four polishing steps. Thus, a mode of operation is for the controller 190 to cause a substrate to be loaded into a substrate carrier 106 at one of the load cups 123*a*, 123*b* and for the substrate carrier 106 to be positioned in turn at each polishing station 100*a*, 100*b*, 100*c*, 100*d* so that the substrate 10 is polished at each polishing station in sequence. After polishing at the last station, the substrate carrier 106 is returned to one of the load cups 123*a*, 123*b*, and the substrate 10 is unloaded from the substrate carrier 106.

Figure 1I:
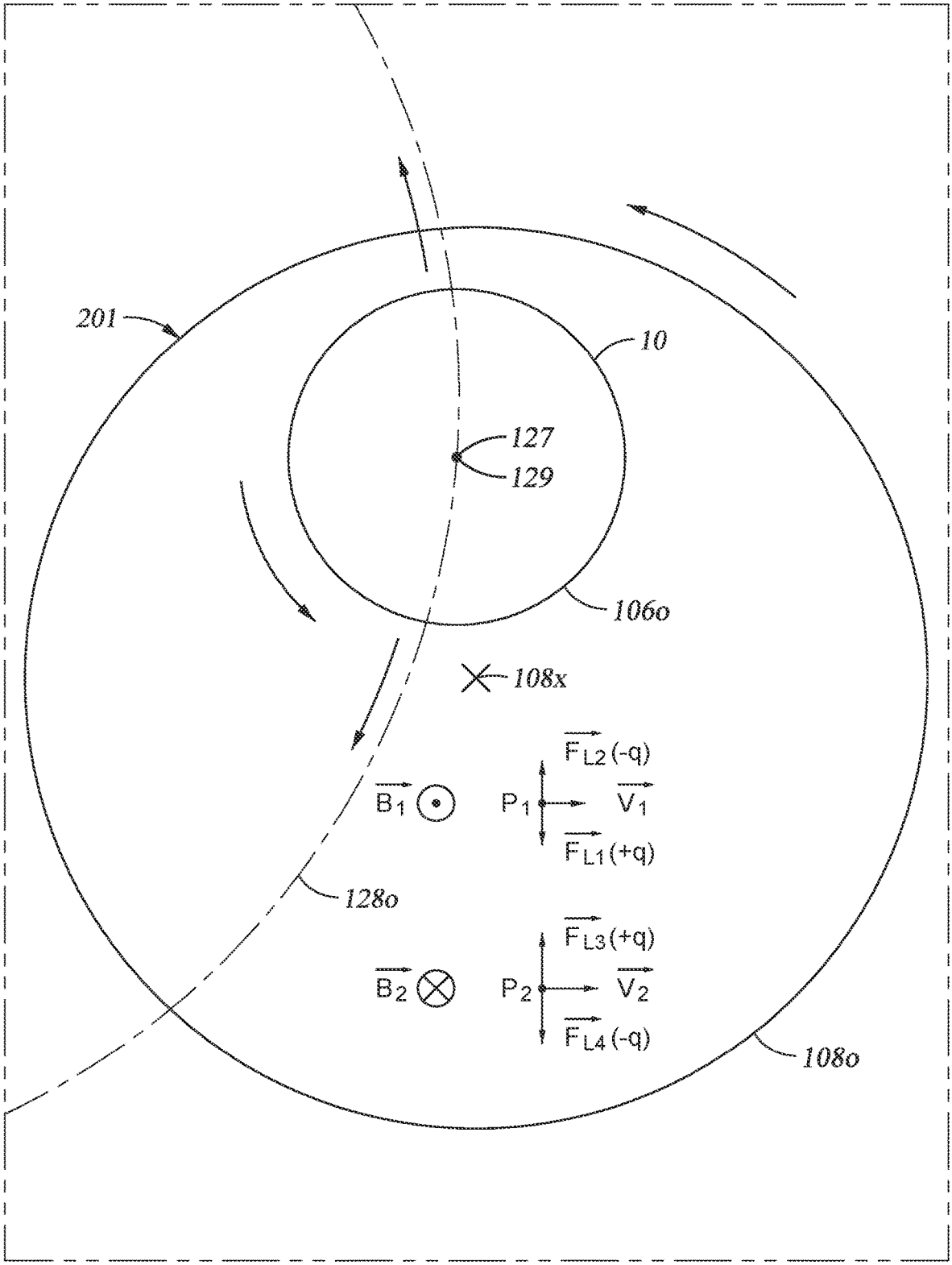
FIG. 1I is a diagram of the path of the outline of a substrate during a polishing cycle using the CMP system of FIG. 1H, according to one or more embodiments.

FIG. 1I is a diagram of the path of the outline of a substrate 10 during a polishing cycle using the CMP system of FIG. 1H. FIG. 1I illustrates an overhead view of the polishing surface 108, which includes substrate carrier outline 106*o*. The substrate carrier outline 106*o* shows the spatial extent of the substrate carrier 106 while being rotated by the carrier head rotation motor 156 about axis 127, with an arrow indicating counterclockwise rotation of the substrate carrier 106. The polishing surface outline 108*o* shows the spatial extent of the entire polishing surface 108, with an 'x' indicating the center of the polishing surface 108*x*, which is aligned with the rotational axis 112 of the platen 104 (FIG. 1A). The electromagnetic assembly 201 is disposed radially within the polishing surface outline 108*o*, with an arrow indicating CCW rotation of the polishing surface 108 and the electromagnetic assembly 201. The overhead track outline 128*o* shows the path the substrate carrier 106 moves across the polishing surface 108, with arrows indicating the motion of the substrate carrier 106 along the overhead track 128. In this embodiment, the offset distance is zero, and the axis 127 and carrier head axis 129 lie on top of one another, and thus illustrates a conventional configuration that has no offset distance.

In one or more embodiments, the magnetic field generated by the components within an electromagnetic device 202 of the electromagnetic assembly 201 within a polishing station 100 of FIGS. 1A-1C induces an electromagnetic force, known as a Lorentz force, on a plurality of charged particles in the polishing slurry disposed adjacent to the electromagnets 210 within an electromagnetic device 202. The Lorentz force $\vec{F}_L$ is governed by the equation $\vec{F}_L = q\vec{v}\times\vec{B}$ where q is the particle charge, $\vec{v}$ is the particle linear velocity vector, and $\vec{B}$ is the magnetic field vector. The slurry particle's velocity vector is created due to the rotation direction and speed of the platen 104 and direction and flow velocity of the slurry solution that is dispensed onto the surface of the platen 104. For a particle having positive charge, the direction of the Lorentz force follows the right hand rule according to the vector cross product of velocity and magnetic field. It will be appreciated that the Lorentz force applied to a negatively-charged particle is oriented opposite the direction of the positively-charged particle. For example, in one or more embodiments illustrated in FIG. 1I, for a particle p1 having a positive charge +q and moving to the right in the plane of the page with linear velocity $\vec{v}$1, a magnetic field $\vec{B}$1 directed out of the page, e.g., from the platen 104 to the substrate carrier 106 (FIG. 1A), will result in a Lorentz force $\vec{F}_{L1}$ being directed downward in the plane of the page, i.e., towards the edge 108*o* of the polishing surface 108. If the same particle p1 has an equal and opposite negative charge −q, then the Lorentz force $\vec{F}_{L2}$ has the same magnitude and opposite direction, instead being oriented upward in the plane of the page, i.e., towards the center 108*x* of the polishing surface 108.

In one or more other embodiments illustrated in FIG. 1I, for a particle p2 having a positive charge +q and moving to the right in the plane of the page (e.g., parallel to the pad surface) with linear velocity $\vec{v}$2, a magnetic field $\vec{B}$2 directed into the page, e.g., from the substrate carrier 106 to the platen 104 (FIG. 1A), will result in a Lorentz force $\vec{F}_{L3}$ being directed upward in the plane of the page, i.e., toward the center 108*x* of the polishing surface 108. If the same particle p2 has an equal and opposite negative charge −q, then the Lorentz force $\vec{F}_{L4}$ has the same magnitude and opposite direction, instead being oriented downward in the plane of the page, i.e., towards the edge 108*o* of the polishing surface 108. Because the particle p2 is located radially outward relative to the particle p1, the linear velocity $\vec{v}$2 is greater than the linear velocity $\vec{v}$1. Therefore, when the absolute value of the charge on the particles p1, p2 is the same and the magnetic field strengths $\vec{B}$1, $\vec{B}$2 are equal, the Lorentz forces $\vec{F}_{L4}$, $\vec{F}_{L3}$ on the particle p2 are greater than the respective Lorentz forces $\vec{F}_{L1}$, $\vec{F}_{L2}$ on the particle p1 as indicated by the difference in arrow size shown in FIG. 1I.

In one or more embodiments, the Lorentz forces $\vec{F}_{L1}$, $\vec{F}_{L2}$, $\vec{F}_{L3}$, $\vec{F}_{L4}$ are configured to overcome total static forces, e.g., surface tension, which maintain the particles p1, p2 stationary with respect to the polishing surface 108, in order to induce radial movement of the particles p1, p2 toward the center 108*x* or edge 108*o* of the polishing surface 108. It will be appreciated that maintaining a constant magnetic field $\vec{B}_1$, $\vec{B}_2$ results in the charged particles p1, p2 being moved along the polishing surface 108 in opposite directions based on charge. In one or more embodiments where a constant magnetic field is maintained over a sustained period of time, a plurality of charged particles in the polishing slurry may adopt a bimodal distribution in a radial direction on the polishing surface 108 based on surface charge. In other words, according to some embodiments, positively-charged particles may have a higher concentration proximate the center 108*x* and a lower concentration near the edge 108*o*, whereas negatively-charged particles have a lower concentration proximate the center 108*x* and a higher concentration near the edge 108*o*, or vice versa. In one or more embodiments, the particle distribution and local concentration can be controlled in the radial direction by adjusting the orientation and magnetic field strength of the magnetic fields B1, B2 as described herein. In one or more embodiments, the controller 190 includes a computer readable medium having instructions stored thereon for altering the movement of the plurality of charged particles by adjusting the magnetic field based on particle charge and particle linear velocity.

In one or more embodiments, an actual surface profile of the substrate 10 is predetermined, e.g., by in situ or ex situ measurement, before starting the polishing process. In some embodiments, a difference between the predetermined surface profile and a target surface profile is determined. In such embodiments, the orientation and magnetic field strength of the magnetic field can be preset using the controller 190 to achieve a predetermined particle distribution and local concentration, which is specifically designed to achieve the target surface profile. In one or more embodiments, the surface profile can be improved, e.g., by removing surface irregularities and increasing surface profile uniformity. In some other embodiments, which can be combined with embodiments described herein, the actual surface profile can be determined during the polishing process based on real-time feedback from one or more in situ sensors (not shown), e.g., eddy current sensors and end point detection sensors. In some embodiments, a difference between the actual surface profile and the target surface profile is continuously updated during polishing. In such embodiments, the orientation and magnetic field strength of the magnetic field can be adjusted during polishing using the controller 190 to alter a distribution of the plurality of charged particles on the polishing surface in order to minimize the difference between the actual and target surface profiles. By controlling the orientation and magnetic field strength of the magnetic field the surface profile can be precisely refined throughout the polishing process. The control of the orientation and magnetic field strength of the magnetic field can be adjusted by time (i.e., polishing recipe based) or by use of a closed loop control system, which includes the use of one or more sensors (e.g., eddy current and/or optical sensors) that are able to detect properties of the surface of the substrate at one or more instants in time.

In one or more embodiments, the particle distribution and local concentration is specifically designed to retain slurry on the polishing surface 108. For example, inducing radial movement of the charged particles p1, p2 toward the center 108*x* of the polishing surface 108 can decrease slurry volume proximate the edge 1080. In such embodiments, the rate of slurry removal from the polishing surface 108 is reduced and average residence time of the slurry is increased, thereby reducing slurry consumption.

Figure 2A:
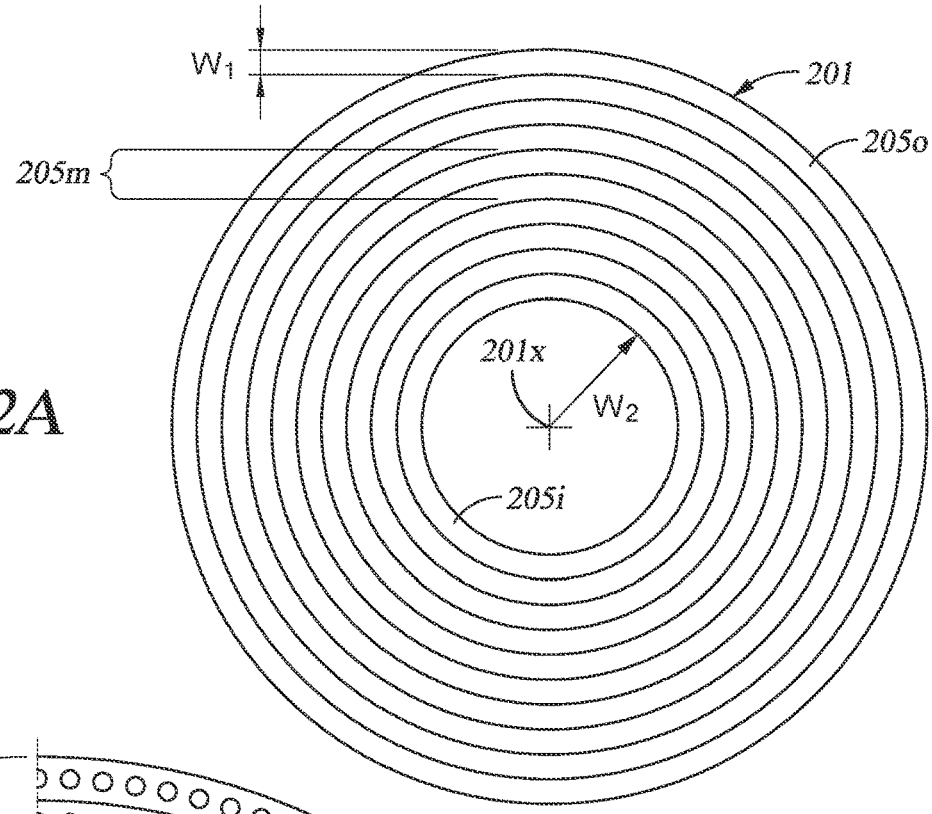
FIG. 2A is a schematic plan view of an exemplary electromagnetic assembly, according to one or more embodiments, which may be used in one or more of the polishing stations described herein.

FIG. 2A is a schematic plan view of an example electromagnetic assembly 201, which may be used in one or more of the polishing stations 100 described herein. In one or more embodiments, the electromagnetic assembly 201 is embedded within the platen 104 (FIG. 1A). In some other embodiments, the electromagnetic assembly 201 is embedded within the polishing pad 102 (FIG. 1B). In some other embodiments, the electromagnetic assembly 201 is embedded within the substrate carrier 106 (FIG. 1C). In one more embodiments, the electromagnetic assembly 201 matches the footprint of the platen 204 and polishing pad 102. In other words, a center 201*x* of the electromagnetic assembly 201 is substantially aligned with the rotational axis 112 of the platen 104, and an edge of the electromagnetic assembly 201 is substantially aligned with an edge of the platen 104.

In one or more embodiments illustrated in FIG. 2A, the electromagnetic assembly 201 has a plurality of different concentric zones, or rings, 205 surrounding the center 201*x*. Here, the electromagnetic assembly 201 has a total of 10 concentric zones. In some other embodiments (not shown), the electromagnetic assembly 201 has 2 or more concentric zones, such as from 2 to 20 concentric zones, such as from 4 to 16 concentric zones, such as from 8 to 12 concentric zones, such as 10 concentric zones. Here, the outline of each concentric zone 205 is circular. In some other embodiments (not shown), the outline may be polygonal, e.g., square, zig-zag, wavy, or combinations thereof. Here, each concentric zone 205 has an equal width w1 measured in the radial direction. In certain embodiments, the width w1 is about 5 mm or greater, such as from about 5 mm to about 50 mm, such as from about 10 mm to about 25 mm, such as about 20 mm. In some other embodiments (not shown), one or more concentric zones 205 have differing widths in the radial direction. Here, the electromagnetic assembly 201 does not cover a center portion of the platen 104 surrounding the rotational axis 112, which is aligned with a center of the electromagnetic assembly 201*x*. In some embodiments, a width w2 measured in the radial direction from an innermost concentric zone 205*i* to the center 201*x* is about 50 mm or less, such as from about 5 mm to about 50 mm, such as about 25 mm. In some other embodiments (not shown), the electromagnetic assembly 201 covers the center portion of the platen 104.

In some embodiments, each concentric zone 205 includes a plurality of electromagnetic devices 202 that are each configured to generate a magnetic field oriented in a direction substantially orthogonal to the polishing surface 108. In one or more embodiments, each of the plurality of electromagnetic devices 202 within a concentric zone 205 generates a magnetic field oriented in a direction opposite the magnetic field orientation of each of the plurality of electromagnetic devices 202 within an adjacent concentric zone 205. In such embodiments, the direction of Lorentz forces applied to the plurality of charged particles in the polishing slurry is reversed for each adjacent concentric zone 205. For example, in such embodiments, when the magnetic field orientation of the plurality of electromagnetic devices 202 within the innermost concentric zone 205*i* is out of the page, the magnetic field orientation of the plurality of electromagnetic devices 202 within the next concentric zone 205 is into the page and so on. In such embodiments, a multimodal distribution of charged particles can be produced whereby alternating concentric zones 205 have alternating high and low concentrations of positively- and negatively-charged particles. In some other embodiments, the magnetic field orientation of each concentric zone is individually controlled. In some embodiments, the plurality concentric zones 205 provide additional control of particle distribution and local concentration on the polishing surface 108 relative to using a single zone (FIGS. 1A and 1I). Enhanced control of particle distribution and local concentration, in turn, can enhance surface profile control of the substrate 10 during polishing.

Figure 2B:
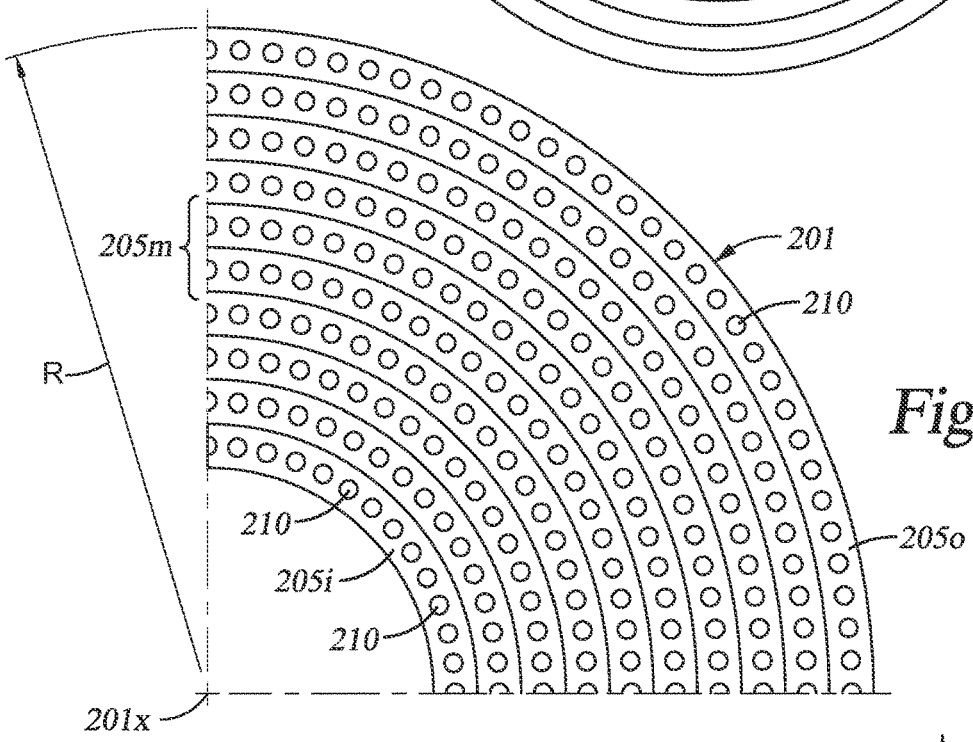
FIG. 2B is an enlarged schematic plan view of a portion of FIG. 2A.

FIG. 2B is an enlarged schematic plan view of a portion of FIG. 2A illustrating the plurality of electromagnets 210 of an electromagnetic device 202 within the electromagnetic assembly 201, according to one or more embodiments. The electromagnets 210 are arranged in rings which are circumferentially aligned within each of the plurality of concentric zones 205. In other words, each of the electromagnets 210 in the same concentric zone 205 are equally radially spaced from the center 201*x*. In some embodiments, the density of the electromagnets 210 in one or more of the concentric zones 205 is different from the density in one or more other concentric zones 205. In one or more embodiments illustrated in FIG. 2B, the density of the electromagnets 210 in each concentric zone 205 is substantially the same. In such embodiments, the number of electromagnets 210 in each concentric zone 205 increases with increasing radial distance R from the center 201*x*. In some embodiments, the density of the electromagnets 210 may be from about 0.1 per linear inch to about 10 per linear inch, such as from about 0.1 per linear inch to about 1 per linear inch, alternatively from about 1 per linear inch to about 5 per linear inch, alternatively from about 5 per linear inch to about 10 per linear inch. In some embodiments, the spacing between the electromagnets 210 within the same concentric zone 205 may be from about 0.1 inches to about 10 inches, such as from about 0.1 inches to about 1 inch, alternatively from about 1 inch to about 5 inches, alternatively from about 5 inches to about 10 inches.

In some embodiments of the electromagnetic assembly 201, it may be desirable to form an electromagnetic assembly 201 that has an unequal radial spacing of the electromagnets 210, such as in a case where the electromagnets 210 are arranged or grouped into sectors versus in concentric rings. Additionally, in some embodiments of the electromagnetic assembly 201, it may be desirable to form an electromagnetic assembly 201 that has an unequal concentric spacing of the electromagnets 210, and thus the spacing within a concentric ring (e.g., middle concentric zone 205*m*) may not be circumferentially uniform.

In some embodiments, it may be desirable to generate a magnetic field without using electrical power. In such embodiments, the plurality of electromagnets 210 illustrated in FIGS. 2A-2B may be replaced with a plurality of permanent magnets (not shown). Beneficially, the use of permanent magnets reduces overall complexity associated with the electrical wiring for powering the plurality of electromagnets 210. In one or more embodiments, a longitudinal axis of each permanent magnet is oriented substantially orthogonal to the polishing surface 108. In some embodiments, the plurality of permanent magnets are configured to generate a fixed or non-adjustable magnetic field within one or more concentric rings. In some embodiments, the plurality of permanent magnets are configured to generate a magnetic field which depends on a density, distribution profile, orientation, and magnetic field strength of each of the plurality of permanent magnets. For example, it may be desirable to vary the density of the plurality of permanent magnets such that the magnets are non-uniformly distributed in the polishing pad 102 or platen 104 to generate a fixed magnetic field which varies across the polishing surface 108. For example, it may be desirable to position the magnets to generate a stronger magnetic field near the center and edge of the polishing surface 108 compared to the region in the middle in order to capture a greater concentration of charged particles near the center and edge of the polishing surface 108. It will be appreciated that distributing the charged particles according this scheme may improve polishing uniformity of substrates that are edge thick by concentrating the charged particles along the edge of the substrate. In certain examples, the density may decrease moving from the innermost concentric zone 205*i* proximate the center 201*x* to the middle concentric zone 205*m*, and the density may increase moving from the middle concentric zone 205*m* to the outermost concentric zone 205*o* at the edge of the platen 104.

Figure 2C:
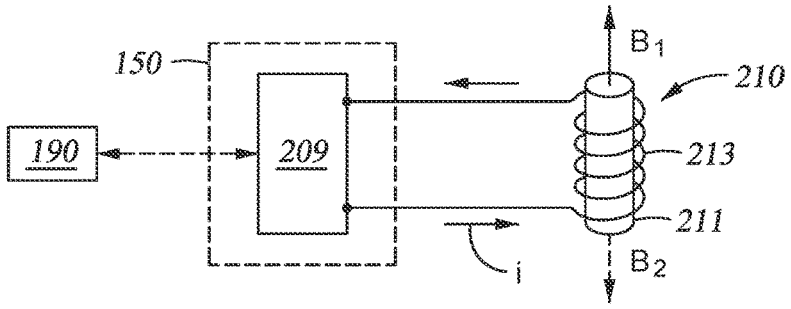
FIG. 2C illustrates an exemplary electromagnetic control circuit, according to one or more embodiments, which may be used in one or more of the electromagnetic assemblies described herein.

FIG. 2C illustrates an example electromagnetic control circuit within an electromagnet device 202, which may be used in one or more of the electromagnetic assemblies 201 described herein. The control circuit includes the EM voltage source 150 and one or a plurality of electromagnets 210 electrically coupled thereto. The EM voltage source 150 includes a power supply 209, which receives control signals from the controller 190. The power supply 209 supplies electrical voltage at a desired polarity and magnitude to the winding disposed within the electromagnets 210. In one or more embodiments, the one or the plurality of electromagnets 210 include a core 211 and a winding that includes a length of wire 213. Here, the wire 213 is wound around the core 211 such that the wire 213 forms a coil, in which adjacent turns of the wire 213 have a number of windings that affects the magnetic field strength at a given supplied current (i.e., magnetic flux density $B=\mu_0 NI$, where $\mu_0$ is the vacuum permittivity constant, N is the number of turns, and I is the current). The number of turns is proportional to the magnetic field strength of the electromagnet 210, e.g., greater the number of turns generates a stronger magnetic field by increasing current density in the coil. In some embodiments, the core 211 is formed form a ferromagnetic or ferrimagnetic material. In such embodiments, a central axis of the coil is substantially aligned with a longitudinal axis of the core 211 for increasing the magnetic flux density therethrough. In one or more embodiments depicted in FIG. 2C, electrical current through the wire 213 generates a magnetic field which is oriented at least in part along the longitudinal axis of the core 211. In one or more embodiments, the longitudinal axis of the core 211 is oriented substantially orthogonal to the polishing surface 108. Here, electrical current in the direction indicated by the arrows generates a magnetic field B1 which is oriented substantially upwardly along the y-axis, e.g., from the platen 104 toward the substrate carrier 106 (FIG. 1A). Reversing the direction of the electrical current reverses the direction of the magnetic field, e.g., generating an opposite magnetic field B2 (shown in phantom) which is oriented substantially downwardly along the y-axis, e.g., from the substrate carrier 106 toward the platen 104 (FIG. 1A). Increasing or decreasing the electrical current causes a proportional increase or decrease, respectively, in the magnetic field strength generated by the electromagnetic assembly 201.

Figure 3A:
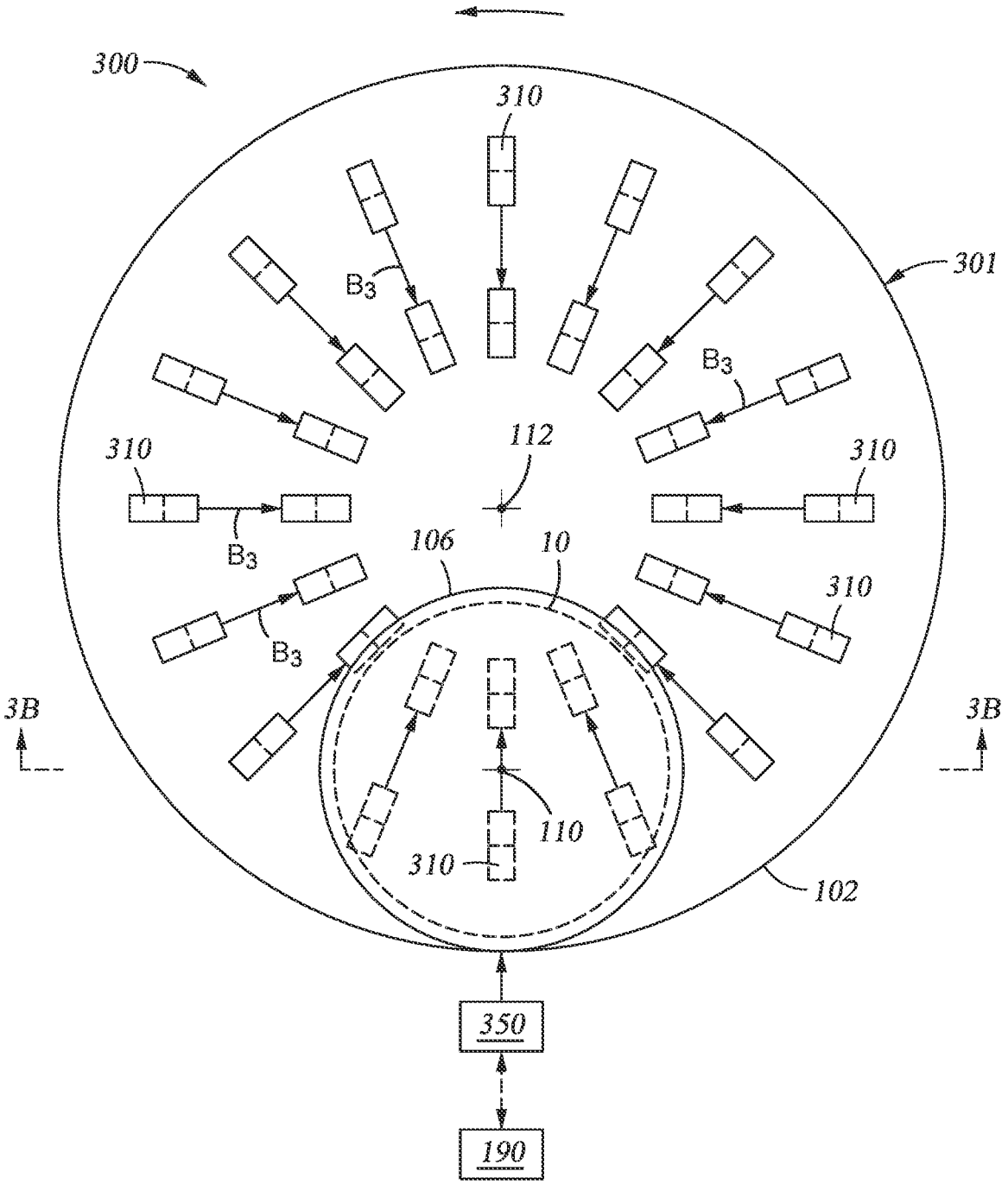
FIG. 3A is a schematic plan view of another exemplary polishing station, according to one or more embodiments, which may be used as the polishing station for one or more of the polishing systems described herein.
Figure 3B:
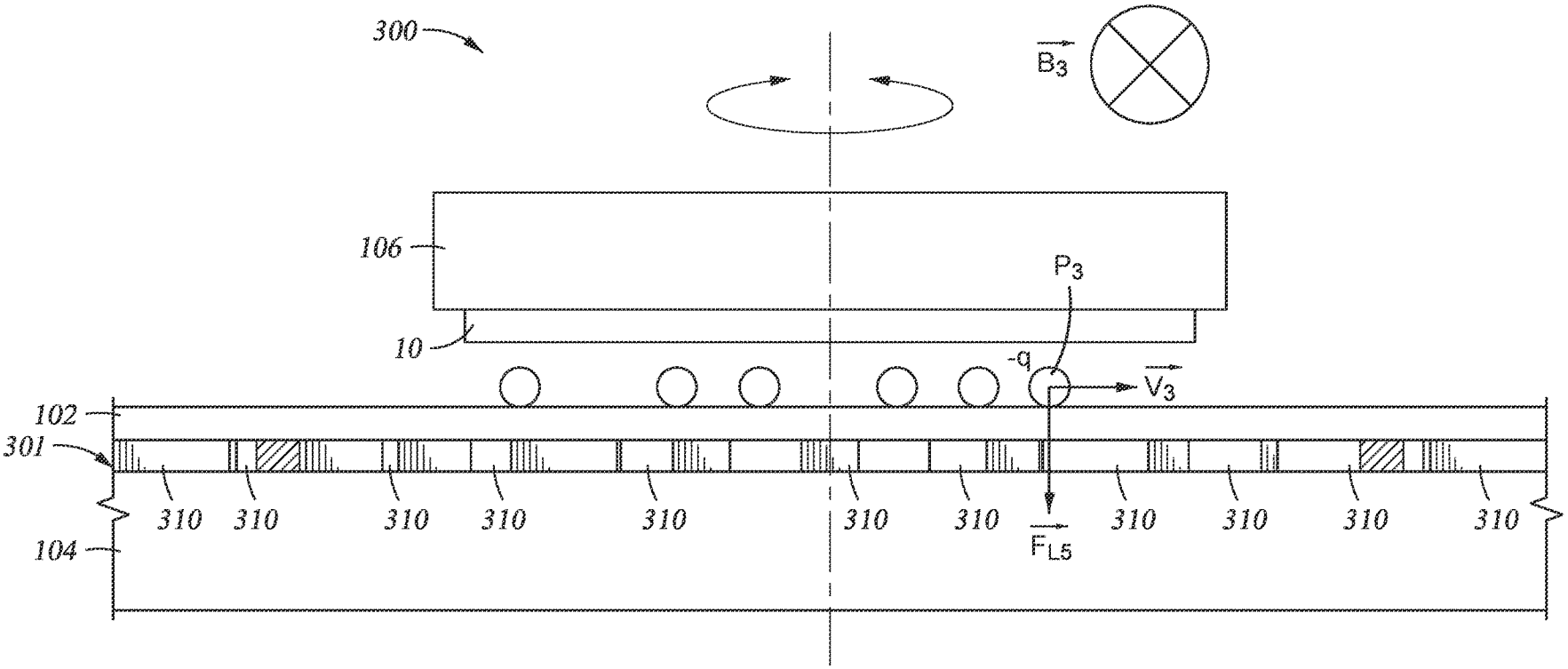
FIG. 3B is an enlarged side sectional view taken along section line 3B-3B of FIG. 3A.

FIG. 3A is a schematic plan view of an example polishing station 300, which may be used as the polishing station for one or more of the polishing systems described herein. FIG. 3B is an enlarged side sectional view taken along section line 3B-3B of FIG. 3A. Similar to the embodiment of FIG. 1A, the electromagnetic assembly 301 is disposed between the platen surface 105 and the polishing pad 102 (FIG. 3B). However, it is contemplated that the electromagnetic assembly 301 may instead be embedded within one of the platen 104 or the polishing pad 102. Similar to the embodiment of FIG. 1A, the electromagnetic assembly 301 includes a plurality of electromagnets 310 which are incorporated into one or a plurality of electromagnetic devices similar to the electromagnetic device 202 of FIG. 2C which includes the electromagnet 210. However, in contrast to the embodiment of FIG. 1A, the plurality of electromagnets 310 are oriented parallel to the platen surface 105 so that the resulting magnetic field B3 is oriented substantially parallel to the polishing surface 108 and/or the surface of the substrate 10 when the substrate 10 is disposed in the substrate carrier 106. It may be desirable that the positioning of the plurality of electromagnets 310 is selected to generate a substantially uniform magnetic field across the polishing surface 108 and/or the surface of the substrate 10. In the embodiment of FIG. 3A, the plurality of electromagnets 310 are disposed in a plurality of concentric rings which are oriented in a radial direction with respect to the platen 104 so that the resulting magnetic field B3 is oriented substantially through the platen axis 112. However, it is contemplated that the plurality of electromagnets 310 may be disposed within a single ring or within three or more rings as opposed to the two concentric rings which are shown in FIG. 3A. It may also be desirable that the number of the plurality of electromagnets 310 is selected to generate a magnetic field across the polishing surface 108 and/or the surface of the substrate 10 which is substantially uniform and also is able to generate sufficient magnetic field strength to carry out the polishing and cleaning operations which are described in more detail below. For example, in each ring, the number of electromagnets 310 may be within a range of about 8 to about 24, such as about 16. In total, the number of electromagnets 310 may be within a range of about 16 to about 48, such as about 24 to about 40, such as about 32. The electromagnetic assembly 301 is electrically coupled to a voltage source 350, such as a battery, for supplying electrical voltage to the plurality of electromagnets 310. The voltage source 350 is communicatively coupled to the controller 190, which is described in more detail with respect to the embodiment of FIG. 1A.

In some other embodiments (not shown), the plurality of electromagnets 310 are positioned proximate an edge of the polishing pad 102 and radially surrounding the polishing pad 102 so that the magnetic field B3 is directed from outside the circumference of the polishing pad 102. In some embodiments, the plurality of electromagnets 310 form a ring encircling at least a portion of the polishing pad 102. The plurality of electromagnets 310 may be oriented so that the magnetic field B3 is substantially through the carrier axis 110 of the substrate carrier 106. However, it is also contemplated that the magnetic field B3 may be oriented between the carrier axis 110 and the platen axis 112, or oriented at another angle relative to the platen axis 112. In such embodiments, the plurality of electromagnets 310 includes from 2 to 12 electromagnets, such as from 2 to 6 electromagnets, such as 3 electromagnets. In such embodiments, the electromagnets 310 are spaced radially by about 15 degrees or more, such as from about 15 degrees to about 45 degrees, such as from about 15 degrees to about 30 degrees, such as by about 22.5 degrees. However, it is also contemplated that only one electromagnet or electromagnetic ring is used in place of the plurality of electromagnets 310.

It will be appreciated that the magnetic field B3 can be controlled similarly to the magnetic fields B1, B2 according to methods described herein, and the magnetic field B3 is operable to induce Lorentz forces on charged particles according to the principles outlined with respect to FIG. 1I. For example, in one or more embodiments illustrated in FIG. 3B, for a particle p3 having a negative charge −q and moving to the right in the plane of the page with linear velocity $\vec{v}$3, a magnetic field $\vec{B}$3 directed into the page, e.g., radially inward toward the carrier axis 110 (FIG. 3A), will result in a Lorentz force $\vec{F}_{L5}$ being directed downward in the plane of the page, i.e., towards the polishing pad 102. If the same particle p3 had an equal and opposite positive charge +q, then the Lorentz force would have the same magnitude and opposite direction, instead being oriented upward in the plane of the page, i.e., towards the substrate carrier 106.

In one or more embodiments illustrated in FIGS. 3A-3B, abrasive particles and/or ions can be controlled by adjusting orientation and magnetic field strength of the magnetic field according to methods described herein. In one or more embodiments illustrated in FIGS. 3A-3B, the magnetic field is applied during at least one of post-polish rinsing or dechucking. For example, during post-polish rinsing or dechucking, the magnetic field B3 may be applied for cleaning in order to lower the defect rate, namely by pulling abrasive particles and/or ions away from the substrate 10 in the substrate carrier 106 and toward the polishing pad 102. In one or more embodiments, the plurality of electromagnets 310 may be combined with the polishing stations 100 of FIGS. 1A-1D so that the magnetic and electric fields can exert a combined effect for removal of charged particles during post-polish rinsing and dechucking. In particular, changing the electric field direction during post-polish rinsing and dechucking helps detach charged particles form the surface of the substrate 10.

In some other embodiments, the magnetic field is applied during polishing. For example, during polishing, the magnetic field can be used to lift slurry, including abrasive particles and/or ions, upward to the interface between the substrate 10 and the polishing surface 108 in order to increase the polishing rate. Also, the magnetic field may be reversed to pull slurry away from the interface in order to decrease the polishing rate.

Polishing Process Cleaner Example

Figure 4A:
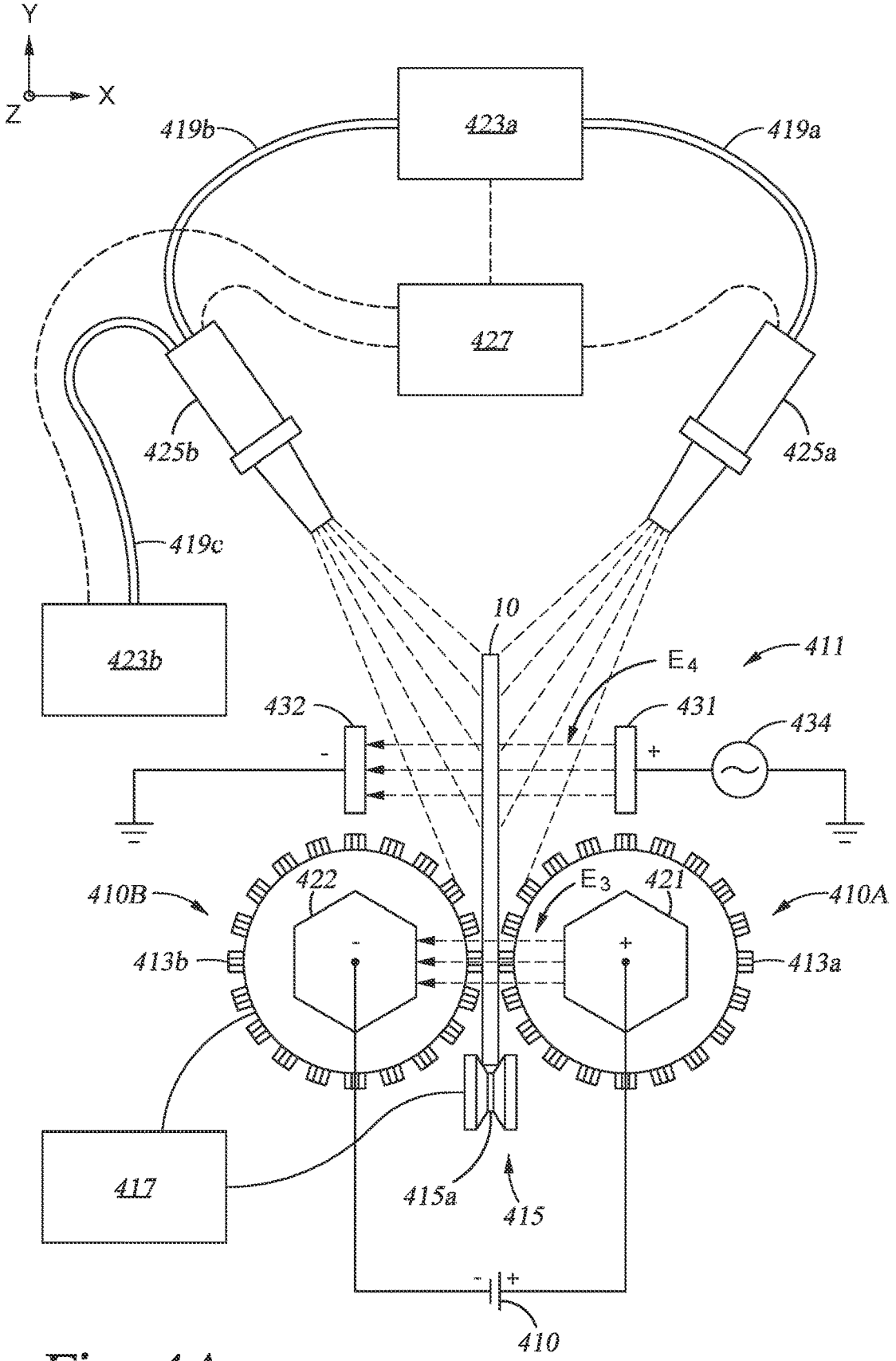
FIG. 4A is a side schematic view of a brush box cleaner, according to one or more embodiments, which may be used to clean a substrate.

FIG. 4A is a side schematic view of a brush box cleaner 411 which may be used to clean a substrate 10, according to one or more embodiments of the disclosure provided herein. The cleaner 411 is configured to support a substrate 10 in a vertical orientation, and is configured to clean both the front and the back sides of the substrate 10. However, the cleaner 411 is not particularly limited to the illustrated embodiment. For example, the cleaner 411 may support a substrate 10 in other orientations, or may clean only one side (front or back) of a substrate 10. The cleaner 411 includes a pair of rotatable scrubbers 410A, 410B arranged on opposite sides of the substrate 10. Each scrubber 410A, 410B includes a plurality of brushes 413*a*, 413*b*. The cleaner 411 includes a platform 415 for supporting the substrate 10 and a mechanism for rotating the pair of scrubbers 410A, 410B. The platform 415 includes a plurality of rollers 415*a* (only one shown), which may be configured to support the substrate 10 vertically with minimal contact and which may be configured to rotate the substrate 10. A motor 417 is coupled to the pair of scrubbers 410A, 410B, and to the plurality of rollers 415*a* to selectively rotate each.

The cleaner 411 includes a plurality of supply lines 419*a*, 419*b*, 419*c* which are fluidly coupled to fluid sources 423*a*, 423*b* for carrying fluid to the cleaner 411. In one or more embodiments, the fluid source 423*a* contains a non-etching fluid, e.g., deionized water or cleaning fluid. In one or more embodiments, the fluid source 423*b* contains an etching fluid, e.g., including acid and an oxidizing agent. A pair of spray nozzles 425*a*, 425*b* are positioned above the pair of scrubbers 410A, 410B. The spray nozzle 425*a* is fluidly coupled to the fluid source 423*a* via the supply line 419*a* for receiving fluid therefrom. Likewise, the spray nozzle 425*b* is fluidly coupled to the fluid source 423*a* via the supply line 419*b* for receiving fluid therefrom. The spray nozzle 425*b* is also fluidly coupled to the fluid source 423*b* via the supply line 419*c* for receiving fluid therefrom. A controller 427 is communicatively coupled to each of the spray nozzles 425*a*, 425*b*. The controller 427 is also communicatively coupled to each of the fluid sources 423*a*, 423*b* and includes instructions for directing the fluids to be supplied to the cleaner 411.

In operation, the scrubbers 410A, 410B rotate in opposite directions, applying forces to the substrate 10 in a first direction, e.g., downward, while the substrate 10 rotates either clockwise or counterclockwise due to rotation of the roller 415*a*. Concurrently, one or more fluids are supplied to the spray nozzles 425*a*, 425*b* for applying the one or more fluids to the substrate 10.

In one or more embodiments illustrated in FIG. 4A, the cleaner 411 is constructed and arranged such that an electric field can be applied to the substrate 10. In one or more embodiments, the applied electric field is configured to detach charged particles from the surface of the substrate 10 when a fluid from one of the fluid sources 423*a*, 423*b* is applied to the surface. Here, the scrubbers 410A, 410B include respective electrodes 421, 422. In one or more embodiments, each of the electrodes 421, 422 are electrically coupled to opposing terminals of a voltage source 410, e.g., a battery. The electrodes 421, 422 are spaced apart from each other at least in part orthogonal to the surface of the substrate 10. Similar to the voltage sources 150, 155, the voltage source 410 is configured to supply electrical voltage to the electrodes 421, 422. Here, supplying voltage having a first polarity generates an electric field E3 which is oriented substantially laterally through the substrate 10 along the x-axis from the electrode 421 to the electrode 422. In one or more embodiments, the voltage source 410 is communicatively coupled to the controller 190 for controlling the orientation and electric field strength of the electric field E3. In certain embodiments, the electric field E3 is controlled based on real-time feedback from in situ sensors.

In operation, application of the electric field E3 applies Coulomb forces to a plurality of charged particles on the surface of the substrate 10 according to methods described herein with respect to the FIG. 1D. The Coulomb forces can selectively cause certain particles to become detached from the surface of the substrate 10. Selective removal of particles based on charge can improve cleaning rates and cleaning efficiency. The electric field E3 attracts negatively-charged particles toward the positive electrode 421 and repels positively-charged particles away from the positive electrode 421 and toward the negative electrode 422. Therefore, the electric field E3 enhances cleaning by selectively removing negatively-charged particles from the surface of the substrate 10 facing the positive electrode 421. In a similar manner, the electric field E3 enhances cleaning by selectively removing positively-charged particles on the surface of the substrate 10 facing the negative electrode 422. An opposite cleaning effect can be realized by reversing the polarity of the electrodes 421, 422. Therefore, in some embodiments, it may be desirable to flip the polarity of the generated electric field by swapping a relative DC voltage polarity (e.g., negative/positive to positive/negative) applied to one or both of the electrodes one or more times during a cleaning process. In some embodiments, it may be desirable to use pulsed DC voltage, which can switch between ON/OFF or positive/negative. The pulse time may be from about 1 second to about 120 seconds, and the stop time may be from about 0.1 seconds to about 10 seconds. For example, the pulsed DC voltage can switch between two seconds ON and two seconds OFF. Alternatively, the pulsed DC voltage can switch between two seconds positive and two seconds negative. However, it is contemplated that the switching can occur at any suitable timeframe. In some embodiments, it may be desirable to use an AC voltage source that is applied to one or both of the electrodes to achieve an alternating electric field direction between the electrodes.

In one or more other embodiments illustrated in FIG. 4A, a pair of external electrodes 431, 432 are positioned adjacent to surfaces of the substrate 10 disposed in the scrubbers 410A, 410B. Here, the electrode 431 is electrically coupled to an AC voltage source 434, and the electrode 432 is grounded. Here, supplying voltage having a first polarity generates an electric field E4 which is oriented substantially laterally though the substrate 10 along the x-axis from the electrode 431 to the opposite electrode 432. In one or more embodiments, the AC voltage source 434 is communicatively coupled to the controller 190 for controlling the orientation and electric field strength of the electric field E4. In operation, the electrodes 431, 432 are operative to improve cleaning of the substrate 10 according to methods described herein with respect to the electrodes 421, 422. In one or more embodiments, the cleaner 411 is configured to apply the electric field E3, the electric field E4, or both.

Figure 4B:
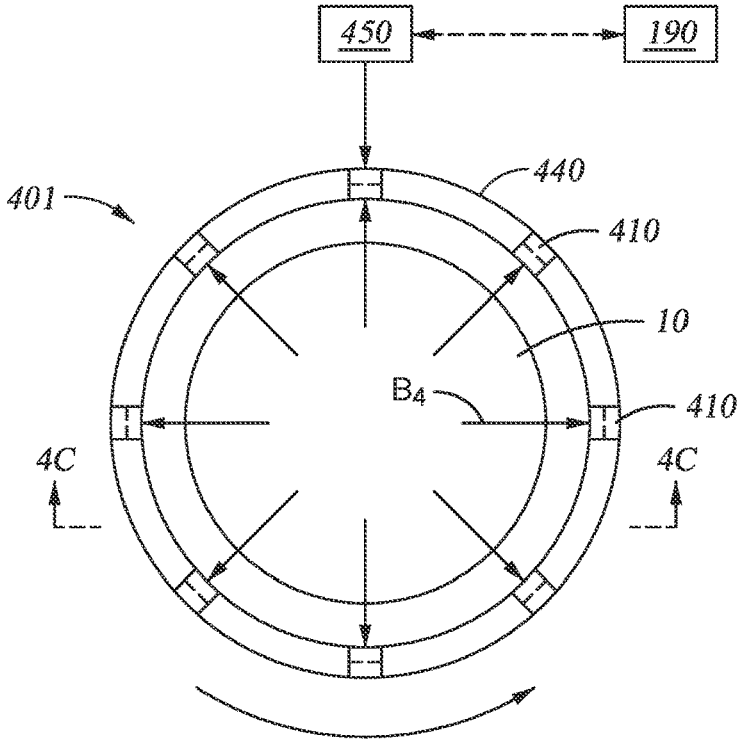
FIG. 4B is a side schematic view of an electromagnet, according to one or more embodiments, which may be used in combination with the cleaner of FIG. 4A.

FIG. 4B is a schematic view of an electromagnetic assembly 401 including a plurality of electromagnets 410 (e.g., electromagnetic devices 202) disposed around an outer edge of a vertically oriented substrate 10, which may be used in combination with the cleaner 411 of FIG. 4A. The plurality of electromagnets 410 are coupled to an annular ring 440. The electromagnetic assembly 401 which is electrically coupled to a voltage source 450, e.g., a battery, for supplying electrical voltage to the plurality of electromagnets 410. The voltage source 450 is communicatively coupled to the controller 190. In one or more embodiments, which can be combined with other embodiments described herein, the cleaner 411 includes the plurality of electromagnets 410 for inducing a magnetic field B4 which is oriented radially outward from a center of the substrate 10 as shown in FIG. 4B. In some embodiments, the plurality of electromagnets 410 are oriented so that the magnetic field B4 is substantially uniform around the circumference of the substrate 10. In certain embodiments, the magnetic flux density is greater at the edge of the substrate 10 than at the center resulting in higher rates of particle removal at the edge of the substrate 10 compared to the center. The magnetic poles of each individual electromagnet 410 are aligned parallel to the surface of the substrate 10 and oriented in the same direction (e.g., each N magnetic pole facing radially outward). It will be appreciated that the magnetic field B4 can be controlled similarly to the magnetic fields B1, B2 according to methods described herein. The operability of the magnetic field B4 to induce Lorentz forces on charged particles is described in more detail below with respect to FIG. 4C.

Figure 4C:
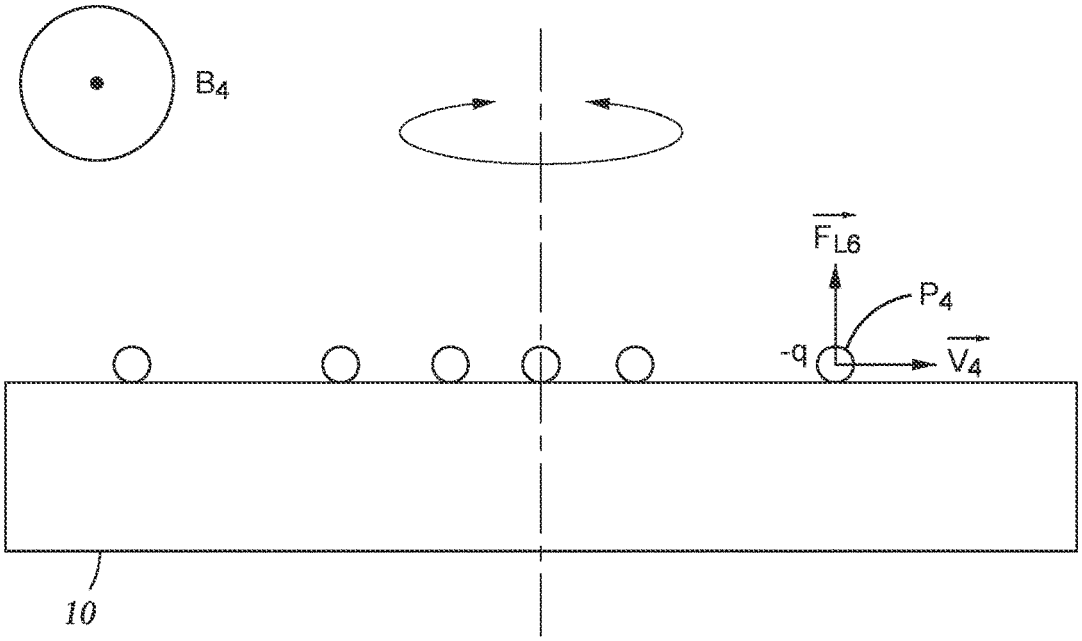
FIG. 4C is an enlarged side sectional view taken along section line 4C-4C of FIG. 4B.

FIG. 4C is an enlarged side sectional view taken along section line 4C-4C of FIG. 4B. In one or more embodiments illustrated in FIG. 4C, for a particle p4 having a negative charge −q and moving to the right in the plane of the page with linear velocity $\vec{v}$4, a magnetic field $\vec{B}$4 directed out of the page, e.g., radially outward from the center of the substrate 10 (FIG. 4B), will result in a Lorentz force $\vec{F}_{L6}$ being directed upward in the plane of the page, i.e., away from the substrate 10.

In one or more embodiments illustrated in FIGS. 4B-4C, particle removal from the substrate 10 during brush box cleaning can be controlled by adjusting the orientation and magnetic field strength of the magnetic field according to methods described herein. For example, during cleaning, the magnetic field B4 may be applied in order to pull charged particles away from the substrate 10 and towards the scrubbers 410A, 410B. In one or more embodiments, one or more of the electric fields E3, E4 can be combined with the magnetic field B4 working in the same direction in order to generate an additive force greater than each individual force in order to more effectively detach charged particles from the surface of the substrate 10.

In one or more embodiments, the apparatus and methods described herein are compatible with existing polishers and cleaners. In one or more embodiments, the apparatus and methods described herein are compatible with metal CMP, dielectric CMP, other semiconductor material CMP, and combinations thereof.

While the foregoing is directed to embodiments of the present disclosure, other and further embodiments of the disclosure may be devised without departing from the basic scope thereof, and the scope thereof is determined by the claims that follow.

The invention claimed is:

1. A polishing station for polishing a substrate using a polishing slurry, the polishing station comprising:

a substrate carrier having a substrate-receiving surface;

a rotatable platen having a polishing pad disposed on a platen surface, wherein the polishing pad has a polishing surface facing the substrate-receiving surface; and an electromagnetic assembly disposed over the platen surface, the electromagnetic assembly comprising an array of electromagnetic devices disposed in a plurality of concentric rings that do not cover a center of the polishing surface, wherein each of the electromagnetic devices is operable to generate a magnetic field that is configured to pass through the polishing surface, the magnetic fields generated by the array of the electromagnetic devices are oriented and configured to induce an electromagnetic force on a plurality of charged particles disposed in a polishing slurry disposed on the polishing surface, and the generated magnetic fields are configured to induce movement of the plurality of charged particles in a direction parallel to the polishing surface.

2. The polishing station of claim 1, wherein the electromagnetic assembly is disposed between the platen surface and the polishing pad.

3. The polishing station of claim 1, wherein the electromagnetic assembly is disposed in the polishing pad.

4. The polishing station of claim 1, wherein the array of the electromagnetic devices comprises at least one of a plurality of electromagnets, a plurality of permanent magnets, or a combination thereof, and wherein a longitudinal axis of each electromagnetic core or permanent magnet is oriented substantially orthogonal to the polishing surface.

5. The polishing station of claim 1, wherein each of the plurality of concentric rings is operable to generate a magnetic field having an opposite magnetic field orientation relative to each adjacent concentric ring.

6. The polishing station of claim 4, wherein the polishing station further comprises:

a voltage source electrically coupled to the plurality of electromagnets; and a controller communicatively coupled to the voltage source, wherein the voltage source is operable to control an orientation and magnetic field strength of the plurality of electromagnets based on instructions executed by the controller.

7. The polishing station of claim 6, wherein the controller comprises a computer readable medium having instructions stored thereon for a method comprising:

altering the movement of the plurality of charged particles by adjusting the magnetic field based on particle charge and particle linear velocity.

8. The polishing station of claim 7, wherein the plurality of charged particles on the polishing surface adopt a bimodal distribution in the radial direction.

9. A method of polishing a substrate, the method comprising:

rotating a substrate disposed on a substrate-receiving surface;

rotating a polishing pad disposed on a rotatable platen, wherein the polishing pad has a polishing surface;

urging a surface of the substrate against the polishing surface in the presence of a polishing slurry; and generating a magnetic field that extends through the polishing surface, wherein the magnetic field is generated by an electromagnetic assembly disposed over a surface of the rotatable platen, the electromagnetic assembly comprising an array of electromagnetic devices disposed in a plurality of concentric rings that do not cover a center of the polishing surface, and the generated magnetic field is configured to apply a force to a plurality of charged particles disposed in the polishing slurry.

10. The method of claim 9, wherein the method further comprises controlling an orientation and magnetic field strength of the array of the electromagnetic devices by operating a voltage source based on instructions executed by a controller.

11. The method of claim 10, further comprising:

determining an actual surface profile of the substrate for polishing;

determining a difference between the actual surface profile and a target surface profile; and adjusting the orientation and magnetic field strength of the array of the electromagnetic devices during polishing to alter a distribution of the plurality of charged particles on the polishing surface in order to minimize the difference between the actual and target surface profiles.

12. The method of claim 11, wherein the actual surface profile is predetermined before starting polishing.

13. The method of claim 11, wherein the actual surface profile and the difference between the actual and target surface profiles are continuously updated during polishing.

14. The method of claim 9, wherein the generated magnetic field is configured to induce movement of the plurality of charged particles in a direction at least one of parallel to or orthogonal to the polishing surface.

15. A polishing station, comprising:

a substrate carrier having a substrate-receiving surface;

a rotatable platen having a polishing pad disposed on a platen surface, wherein the polishing pad has a polishing surface facing the substrate-receiving surface; and an electromagnetic assembly disposed proximate an edge of the polishing pad, the electromagnetic assembly comprising an array of electromagnetic devices disposed in a plurality of concentric rings that do not cover a center of the polishing surface, wherein the electromagnetic assembly is operable to generate a magnetic field oriented substantially parallel to the polishing surface, and the generated magnetic field is configured to apply a force to a plurality of charged particles in a polishing slurry.

16. The polishing station of claim 15, wherein the generated magnetic field is configured to induce movement of the plurality of charged particles in a direction substantially orthogonal to the polishing surface.

17. The polishing station of claim 15, wherein the substrate carrier further comprises:

a carrier electrode disposed in the substrate carrier; and a platen electrode disposed between the platen surface and the polishing pad, wherein the carrier electrode and platen electrodes are operable to generate an electric field that is configured to pass through the polishing surface, and wherein the generated electric field is configured to induce an electrostatic force on the plurality of charged particles in the polishing slurry.

18. The polishing station of claim 17, wherein the generated electric field is configured to induce movement of the plurality of charged particles in a direction substantially orthogonal to the polishing surface.

* * * * *